US009284717B2

(12) United States Patent
Umeda et al.

(10) Patent No.: US 9,284,717 B2
(45) Date of Patent: Mar. 15, 2016

(54) SWIVEL CONTROL APPARATUS AND METHOD

(71) Applicant: SUMITOMO(S.H.I.) CONSTRUCTION MACHINERY CO., LTD., Tokyo (JP)

(72) Inventors: Takashi Umeda, Chiba (JP); Kiminori Sano, Chiba (JP); Ryuji Shiratani, Chiba (JP)

(73) Assignee: SUMITOMO(S.H.I.) CONSTRUCTION MACHINERY CO., LTD., Tokyo (JP)

( * ) Notice: Subject to any disclaimer, the term of this patent is extended or adjusted under 35 U.S.C. 154(b) by 0 days.

(21) Appl. No.: 14/305,192

(22) Filed: Jun. 16, 2014

(65) Prior Publication Data

US 2014/0303855 A1 Oct. 9, 2014

Related U.S. Application Data

(63) Continuation of application No. PCT/JP2012/083721, filed on Dec. 26, 2012.

(30) Foreign Application Priority Data

Dec. 28, 2011 (JP) ..... 2011-289430

(51) Int. Cl.

| | |
|---|---|
| ***E02F 9/20*** | (2006.01) |
| ***E02F 9/12*** | (2006.01) |
| ***E02F 9/26*** | (2006.01) |
| ***B66C 13/30*** | (2006.01) |
| ***B66C 23/86*** | (2006.01) |

(52) U.S. Cl.

CPC ..... *E02F 9/2025* (2013.01); *B66C 13/30* (2013.01); *B66C 23/86* (2013.01); *E02F 9/123* (2013.01); *E02F 9/2095* (2013.01); *E02F 9/265* (2013.01)

(58) Field of Classification Search

CPC ..... E02F 9/123; E02F 9/2025; E02F 9/2095
USPC ..... 701/50
See application file for complete search history.

(56) References Cited

U.S. PATENT DOCUMENTS

| | | | | |
|---|---|---|---|---|
| 8,738,239 | B2 * | 5/2014 | Kang et al. | 701/50 |
| 2007/0277986 | A1 | 12/2007 | Morinaga et al. | |
| 2008/0082240 | A1 * | 4/2008 | Kagoshima et al. | 701/50 |
| 2008/0164832 | A1 * | 7/2008 | Kawaguchi et al. | 318/456 |
| 2012/0101696 | A1 * | 4/2012 | Udagawa | 701/50 |

FOREIGN PATENT DOCUMENTS

| | | |
|---|---|---|
| JP | 11-199178 | 7/1999 |
| JP | 2009-127193 | 6/2009 |
| JP | 2010-007265 | 1/2010 |

(Continued)

OTHER PUBLICATIONS

International Search Report mailed on Apr. 9, 2013.

*Primary Examiner* — Rodney Butler
*Assistant Examiner* — Anne Mazzara
(74) *Attorney, Agent, or Firm* — IPUSA, PLLC

(57) ABSTRACT

A swivel control apparatus for swiveling a swivel body that supports an attachment including a boom, an arm, and an end attachment by a motor, wherein a swivel drive command to the motor is changed in conformation with a posture of the attachment.

17 Claims, 18 Drawing Sheets

(56) References Cited

FOREIGN PATENT DOCUMENTS

| | | | |
|---|---|---|---|
| WO | 2006/054582 | 5/2006 | |
| WO | 2010/095585 | 8/2010 | |
| WO | 2010/150846 | 12/2010 | |
| WO | WO 2010/150846 | * | 12/2010 |

* cited by examiner

SWIVEL CONTROL APPARATUS AND METHOD

RELATED APPLICATION

This application is a continuation application of and is claiming benefit under 35 U.S.C. 120 and 365(c) of PCT International Patent Application No. PCT/JP2012/083721 filed on Dec. 26, 2012 and designating the U.S., which claims priority to Japanese Patent Application No. 2011-289430 filed on Dec. 28, 2011. The entire content of the foregoing applications are incorporated herein by reference

BACKGROUND

1. Technical Field

The present invention relates to a swivel control apparatus for controlling a swivel motion of an electrical swivel mechanism such as a construction machine and a method of controlling the swivel.

2. Description of Related Art

In a construction machine such as a shovel, an electrical swivel mechanism where a motor is used as a power source for a swivel mechanism for swiveling an upper-part swivel body may be used. The upper-part swivel body of the shovel is provided with a cabin including an operator's room. A boom is supported by an upper-part swivel body so as to be rotatable. Therefore, a boom and an operation element such as an arm connected to a leading end of the boom and a bucket connected to the leading end of the boom swivel together with the upper-part swivel body. A cabin including an operator's room is provided in the upper-part swivel body. An operator operating a shovel in the operator's room swivels together with the boom and the arm when the upper-part swivel body swivels. In order to bring the operation element such as the end attachment provided to the leading end of the arm to a position where the operation is performed, the upper-part swivel body is caused to swivel to make the end attachment swivel along with the boom. A shovel having a swivel control apparatus is proposed. According to the shovel, an electric swivel motor for driving the upper-part swivel body is controlled by the swivel control apparatus in conformance to an operation amount of an operation lever.

SUMMARY

According to an embodiment of the present invention, there is provided a swivel control apparatus for swiveling a swivel body that supports an attachment including a boom, an arm, and an end attachment by a motor, wherein a swivel drive command to the motor is generated according to a posture of the attachment.

DETAILED DESCRIPTION

In a control of the above swivel control apparatus, a speed command sent to an electric swivel motor is determined by an operation amount of an operation lever operated by an operator. Said differently, when an operator wish to rapidly move an operation element, the operator makes the operation amount of the operation lever great. With this, a swivel speed command in response to the operation amount of the operation lever is generated, and the electric swivel motor is driven by this swivel speed command. If the operation amount of the operation lever is great, the electric swivel motor suddenly accelerates to thereby increase a revolution speed. Therefore, the upper-part swivel body suddenly accelerates and the swivel speed becomes high.

As described, the swivel speed command is generated based only on the operation amount of the operation lever regardless of the position of the operation element such as a boom, an arm, and a bucket (an end attachment). Therefore, in cases where the boom and the arm are opened and the bucket is positioned far from the swivel center of the upper-part swivel body and where the boom and the arm are folded and the bucket is positioned near from the swivel center of the upper-part swivel body, the swivel speed of the upper-part swivel body is controlled in response to only the operation amount of the operation lever.

Because an operator operates an operation lever inside the cabin of the upper-part swivel body, the operator swivels along with the upper-part swivel body. Then, the operator feels the swivel speed of the upper-part swivel body or the operation element while seeing the boom, the arm, and the bucket. Inventors of the present invention or the like researched a swivel speed actually perceived by the operator. As a result, the operator feels the perceived swivel speed higher than the actual swivel speed in a case where the boom and the arm are opened and the bucket is positioned apart from the swivel center of the upper-part swivel body (in a leading end range).

The range where an operation of the bucket is performed is positioned between the above leading end range and a proximity range. The leading end range and the proximity range are called an actual operation range. In a case where the bucket is in the actual operation range, in order to rapidly perform the operation and enhance working efficiency, the swivel speed of the bucket (i.e., the swivel speed of the upper-part swivel body) is made faster. However, if the swivel speed of the upper-part swivel body is made fast, the operator feels that the swivel speed is too fast. Then, comfortable operational feeling is lost.

Therefore, a development of a technique of variably controlling the swivel speed of the upper-part swivel body based on the position of the end attachment such as the bucket is desired.

Next, embodiments of the present invention are described with reference to figures.

Figure 1:
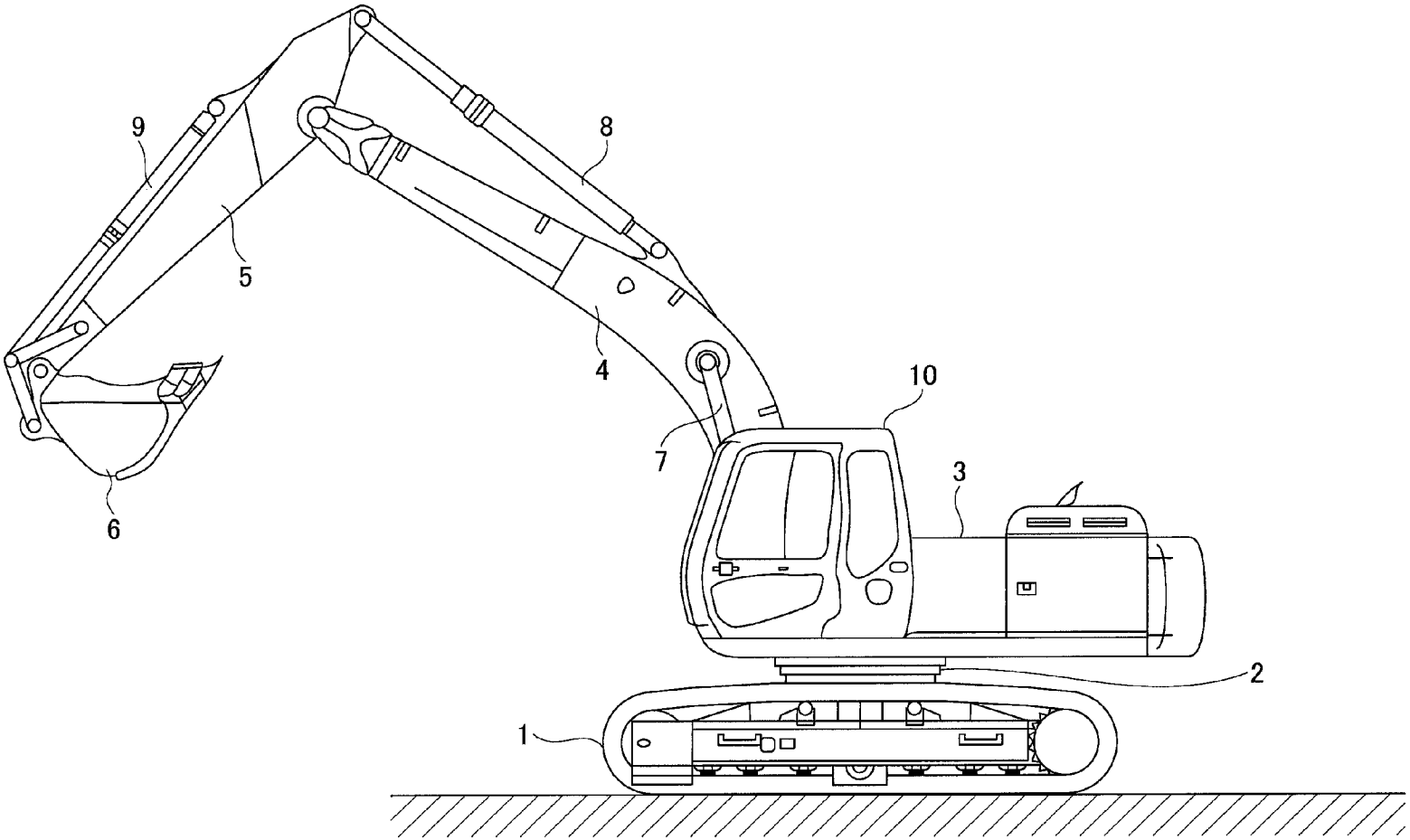
FIG. 1 is a side view of a hybrid shovel, which is an example of a construction machine having a swivel control apparatus, to which the present invention is applicable.

FIG. 1 is a side view of a hybrid shovel as an exemplary construction machine having a swivel control apparatus, to which the present invention is applicable.

An upper-part swivel body 3 is installed in the lower-part travel body 3 through a swivel mechanism 2. A boom 4 is attached to the upper-part swivel body 3. An arm 5 is attached to a leading end of the boom 4, and a bucket 6 is attached to the leading end of the arm 5. A boom 4, the boom 5, and the bucket 6 included in an attachment are hydraulically driven by a boom cylinder 7, an arm cylinder 8, and a bucket cylinder 9, respectively. The upper-part swivel body 3 has a cabin 10 and a power source such as an engine.

Figure 2:
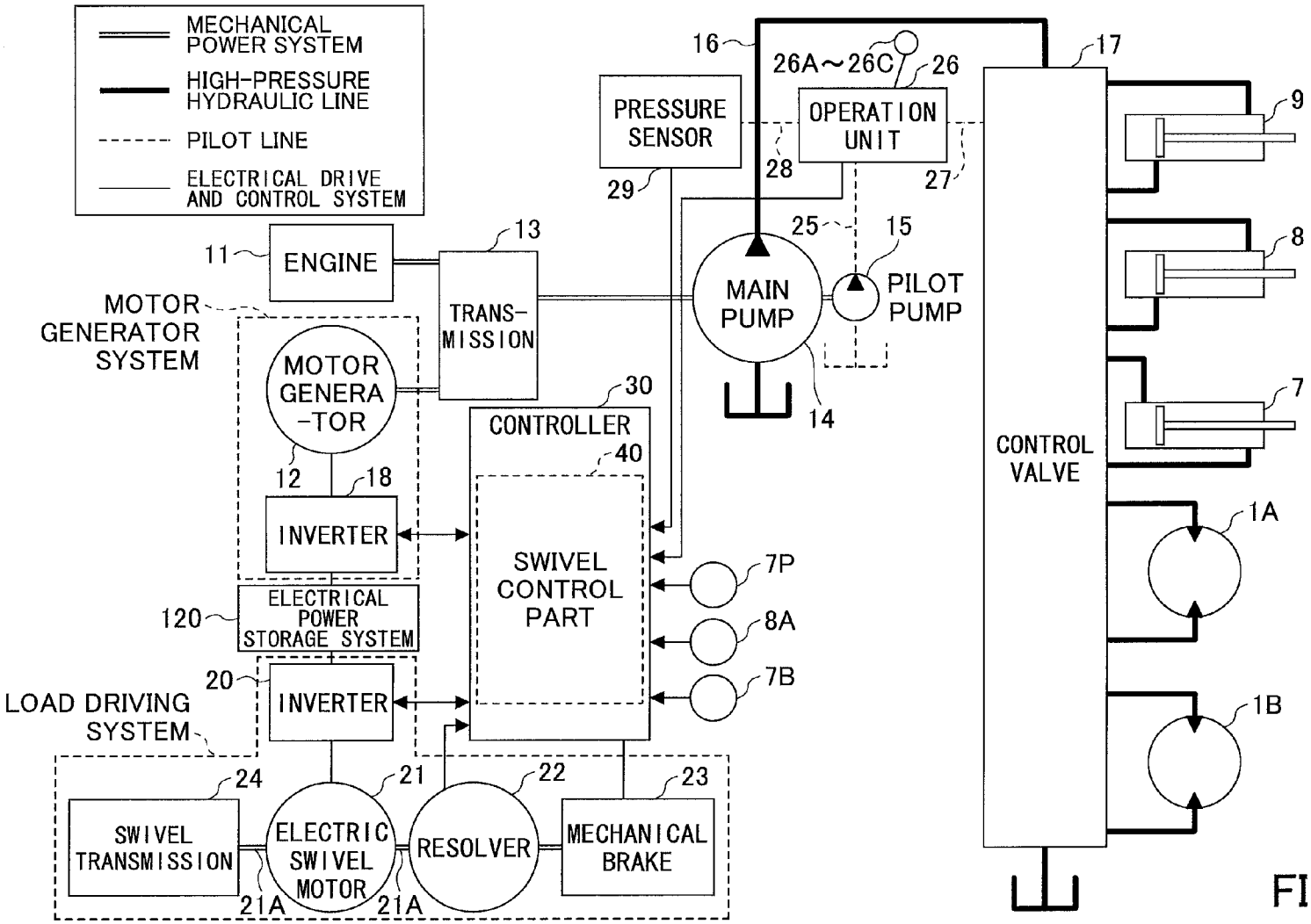
FIG. 2 is a block chart illustrating a structure of a driving system of a hybrid shovel having a swivel control apparatus according to a first embodiment.

FIG. 2 is a block chart illustrating a structure of a drive system of a hybrid shovel having a swivel control apparatus of a first embodiment. Referring to FIG. 2, a mechanical power system is indicated by a double line, a high-pressure hydraulic line is indicated by a solid line (a bold line), a pilot line is indicated by a broken line, and an electrical drive and control system is indicated by a solid line (a thin line). Although the hybrid shovel is exemplified as the construction machine in FIG. 2, the driving method is not limited to a hybrid method. A shovel having an electrical swivel mechanism may be applicable. Further, the construction machine is not limited to the shovel, and may be an operating machine having an electrical swivel mechanism such as a lifting magnet machine having a lifting magnet as an end attachment.

An engine 11 as a mechanical drive part and a motor generator 12 as an assist drive part are both connected to two input shafts of a transmission 13. A main pump 14 and a pilot pump 15 are connected to an output shaft of the transmission 13 as hydraulic pumps. A control valve 17 is connected to the main pump 14 through a high-pressure hydraulic line 16.

The control valve 17 is a control unit that controls a hydraulic system of the hybrid shovel. Hydraulic motors 1A (for the right) and 1B (for the left) for the lower-part travel body 1, the boom cylinder 7, the arm cylinder 8, and the bucket cylinder 9 are connected to the control valve 17 via the high-pressure hydraulic line 16.

An electric power storage system 120 includes a capacitor as an electrical power storage system 120 and is connected to the motor generator 12 through an inverter 18. An electric swivel motor 21 as an operation element is connected to the electrical power storage system 120 through the invertor 20. A resolver 22, a mechanical brake 23, and a swivel transmission 24 are connected to a rotation shaft 21A of the electric swivel motor 21. An operation unit 26 is connected to the pilot pump 15 through a pilot line 25. A load driving system is comprised of the electronic swivel motor 21, the inverter 20, the resolver 22, the mechanical brake 23, and the swivel transmission 24.

The operation unit 26 includes a lever 26A, a lever 26B and a pedal 26C. The lever 26A, the lever 26B and the pedal 26C are connected to the control valve 17 and a pressure sensor 29 through hydraulic lines 27 and 28. The pressure sensor 29 is connected to the controller 30, which controls a drive of an electric system.

Within this embodiment, a boom angle sensor 7B for detecting the angle of the boom 4 is attached to a support shaft of the boom 4. An arm angle sensor 8A for detecting the angle of the arm 5 is attached to a support shaft of the arm 5. The boom angle sensor 7B and the arm angle sensor 8A supply a detected boom angle θB and a detected arm angle θA to the controller 30. Further, a hydraulic pressure sensor 7P for detecting the hydraulic pressure on a bottom side of the boom cylinder 7 is attached to the hydraulic cylinder 7. The hydraulic pressure sensor 7P supplies the detected hydraulic pressure Pb to the controller 30.

Figure 3:
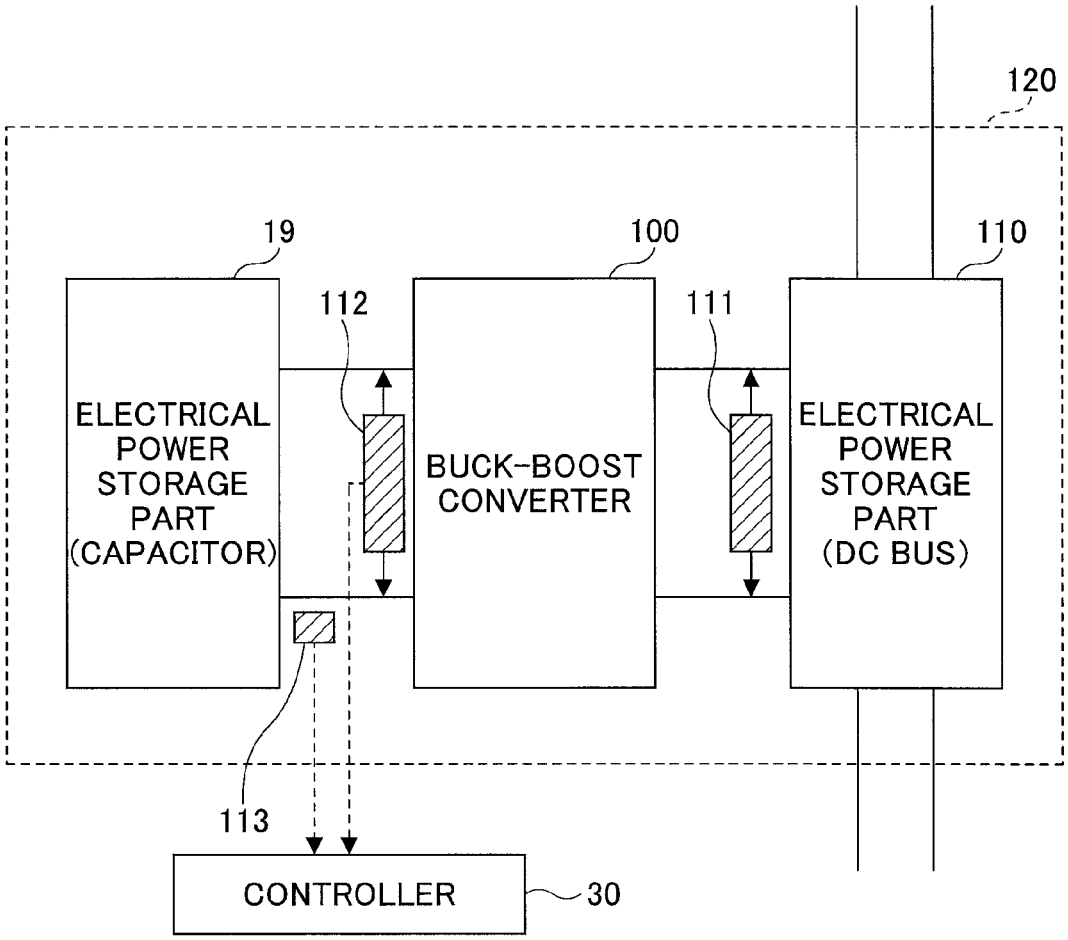
FIG. 3 is a block diagram illustrating a structure of an electrical power storage system.

FIG. 3 is a block chart illustrating a structure of an electric power storage system 120. The electric power storage system 120 includes a capacitor 19 as an electric power storage device, a buck-boost converter 100, and a DC bus 110. The DC bus 110 controls exchanges of electric power among the capacitor 19, the motor generator 12 and the electric swivel motor 21. The capacitor 19 includes a capacitor voltage detecting unit 112 for detecting a capacitor voltage value and a capacitor current detecting unit 113 for detecting a capacitor current value. The capacitor voltage value and the capacitor current value detected by the capacitor voltage detecting unit 112 and the capacitor current detecting unit 113 are supplied to the controller 30. FIG. 3 illustrates the capacitor 19 as the electrical power storage device. However, a chargeable secondary battery such as a lithium ion battery, a lithium ion capacitor, or another mode of a power source capable of exchanging the electrical power may be used instead of the capacitor 19.

The buck-boost converter 100 switches over between the boosting operation and the bucking operation so as to converge a DC bus voltage value within a predetermined range depending on running states of the motor generator 12 and the electric swivel motor 21. The DC bus 110 is arranged among the inverter 18A, an inverter 20, and the buck-boost converter 100 to exchange electric power among the capacitor 19, the motor generator 12, and the swivel motor 21.

Referring back to FIG. 2, the controller 30 is a main controller for controlling a drive of the hybrid shovel. The controller 30 includes an arithmetic processing unit including a central processing unit (CPU) and an internal memory. When the CPU executes a program that controls the drive of the hybrid shovel and is stored in the internal memory, the controller is substantialized.

The controller 30 converts a signal supplied from the pressure sensor 29 to a speed command and controls a drive of the electric swivel motor 21. The signal supplied from the pressure sensor 29 corresponds to a signal indicative of an operation amount of operating the operation unit 26 for swiveling the swivel mechanism 2.

The controller 30 switches over the control of driving the motor generator 12 between a motor (assisting) operation and a generator operation, and simultaneously controls charge or discharge of the capacitor 19 by driving the buck-boost converter 100 as the buck-boost converting unit. The controller 30 controls a switch of the buck-boost converter 100 between an boosting operation and a bucking operation based on a charging state of the capacitor 19, the running state (the motor (assisting) operation or the generation operation) of the motor generator 12, and a running state (a power running operation or a regenerating operation) of the electric swivel motor 21, and performs a charge or discharge control in the capacitor 19 by switching the buck-boost converter 100.

The control of the switch between the boosting operation and the bucking operation in the buck-boost converter 100 is performed based on the DC bus voltage value detected by the DC bus voltage detecting unit 111, the capacitor voltage value detected by the capacitor voltage detecting unit 112, and the capacitor current value detected by the capacitor current detecting unit 113.

In the above described structure, the electric power generated by the motor generator 12 being the assist motor is supplied to the DC bus 110 of the electrical power storage system 120 through the inverter 18A and supplied to the capacitor 19 through the buck-boost converter 100. The regenerative electrical power generated by the electric swivel motor 21 is supplied to the DC bus 110 of the electrical power storage system 120 through the inverter 20 and supplied to the capacitor 19 through the buck-boost converter 100.

The revolution speed (the angular speed ω) of the electric swivel motor 21 is detected by the resolver 22. The angle (the boom angle θB) of the boom 4 is detected by the boom angle sensor 7B such as a rotary encoder provided in the support shaft of the boom 4. The angle (the arm angle θA) of the arm 5 is detected by the arm angle sensor 8A such as a rotary encoder provided in the support shaft of the arm 5. A swivel control part 40 provided in the controller 30 generates a speed command given to the electric swivel motor 21 based on the boom angle θB, the arm angle θA, the hydraulic pressure Pb of the boom cylinder 7 on the bottom side, and the angular speed ω of the electric swivel motor 21. Within the embodiment, the swivel control part 40 is assembled in the controller 30. However, the swivel control part 40 may be a swivel driving unit provided separate from the controller 30.

Figure 4:
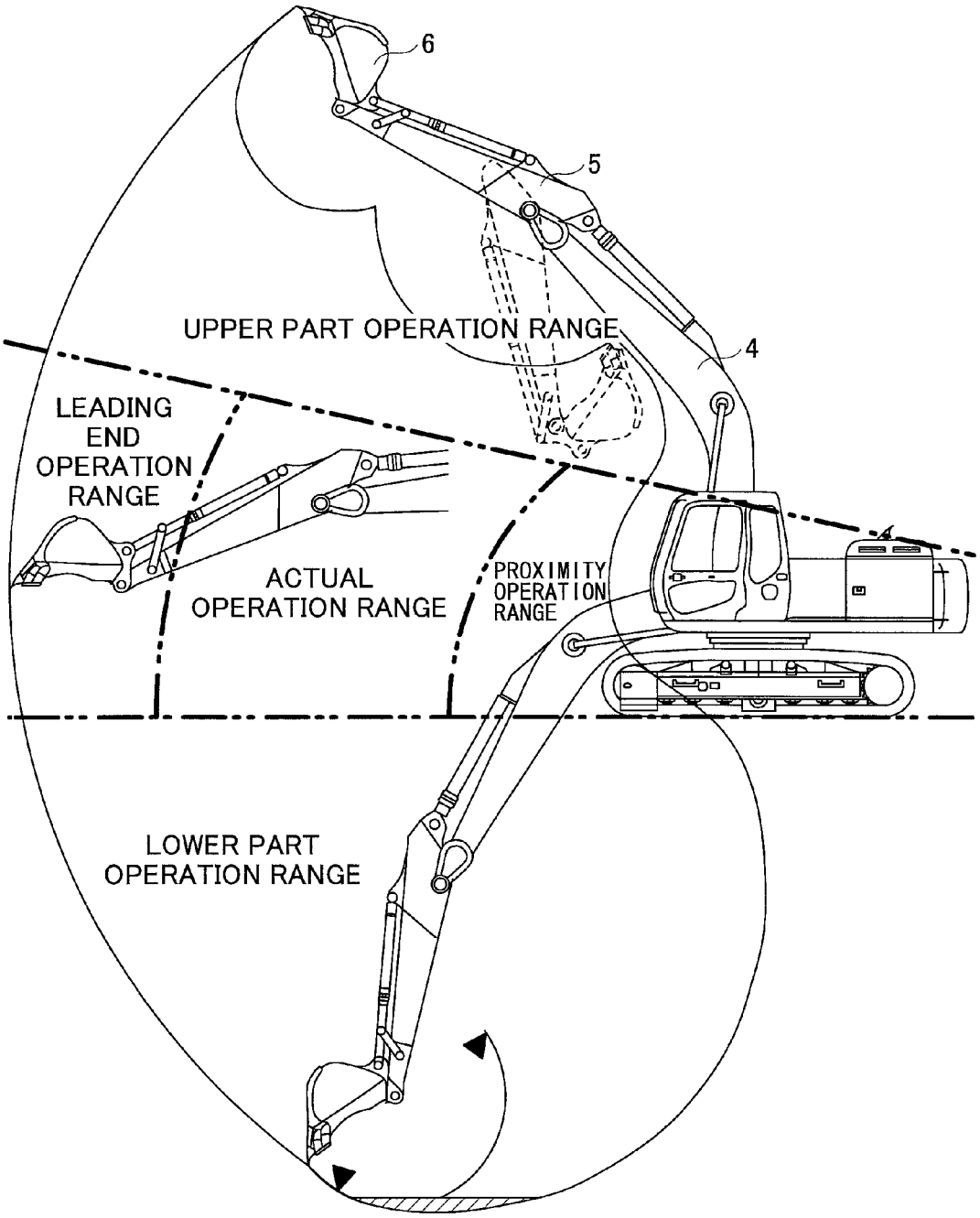
FIG. 4 illustrates an operation range of an operation performed by a hybrid shovel.

In the above hybrid shovel having the above described structure, an operation range where the bucket 6 as the end attachment is attached to the leading end of the arm 5 is described below. FIG. 4 illustrates an operation range of an operation performed by the above hybrid shovel.

The bucket 6 performs an excavation operation and a loading operation. In a state where the boom 4 and the arm 5 are maximally opened (the maximum reach), the operation is scarcely performed. Ordinarily, the operation is performed in a range equal to about 80% or less of the maximum reach of the bucket 6. Meanwhile, in a state where the boom 4 and the arm 5 are completely closed, the operation is scarcely performed. Ordinarily, the operation is performed in a range equal to about 40% or greater of the maximum reach of the bucket 6. Said differently, the ordinary operation is performed in a state where the bucket 6 is positioned between 40% and 80% of the maximum reach. Therefore, the actual operation range is defined as the range between 40% and 80% of the maximum reach. The range exceeding 80% of the maximum reach is referred to as a leading end operation range, and the range less than 40% of the maximum reach is referred to as a proximity operation range.

In the leading end operation range, the driver feels an acceleration and a deceleration of a swivel motion greater than those of an actual swivel motion. For example, in a case where an operator performs the swivel motion by operating the operation lever while the bucket 6 is in a leading end operation range, the operator actually feels the swivel acceleration higher than a swivel acceleration intended by the operator. Therefore, the operator may possibly feel uncomfortable feeling or unpleasant feeling. Therefore, in the leading end operation range, the uncomfortable feeling of the operator is less to make the operator feel comfortableness when the acceleration and the deceleration of the bucket 6 (the upper-part swivel body 3) are not too great.

In a situation where the bucket 6 is positioned above the operator, it is difficult for the operator to directly see the bucket 6. Therefore, when the bucket 6 is positioned above the operator (the upper part operation range), the operation without excessively accelerating or decelerating the bucket 6 (the upper-part swivel body 3) makes the operator comfortable. Especially, it is desirable to reduce the acceleration and the deceleration in the situation where the bucket 6 is positioned outside the field of view. Further, when the bucket 6 is positioned below the ground, the bucket is hard to be seen by the operator. Therefore, when the bucket 6 is positioned below the ground (the lower part operation range), the operation without excessively accelerating or decelerating the bucket 6 (the upper-part swivel body 3) makes the operator comfortable.

As a result, when the bucket is positioned in the leading end operation range, the upper part operation range, and the lower part operation range, a comfortable operation for the operator can be implemented by a swivel acceleration and deceleration smaller than usual. On the other hand, when the bucket is positioned in the proximity operation range, a comfortable operation for the operator can be substantialized by a swivel acceleration greater than usual.

In consideration of the above description, the swivel control part 40 of the above embodiment can substantialize a comfortable operability by variably controlling, the swivel acceleration and deceleration depending on the operation ranges where the end attachment (the bucket, the lift magnet, or the like) is positioned. Specifically, within this embodiment, the comfortable operability for the operator is substantialized by considering the leading end operation range, the proximity operation range, the upper part operation range, and the lower part operation range, and making the acceleration and the deceleration in the actual range less than the acceleration and the deceleration in the leading end operation range and the proximity operation range. Further, the comfortable operability for the operator is substantialized by making the acceleration and deceleration in the proximity operation range greater than the acceleration and deceleration in the actual operation range.

Figure 5:
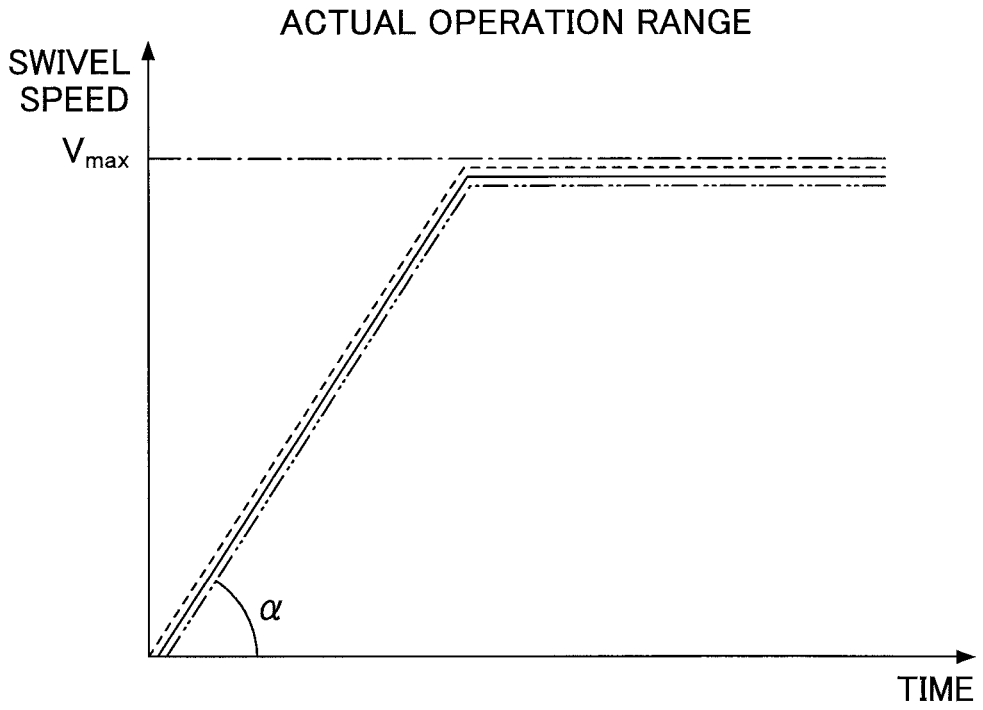
FIG. 5 is a graph illustrating a swivel speed of an upper-part swivel body in an actual operation range.

FIG. 5 is a graph illustrating the swivel speed of the bucket 6 (namely, the upper-part swivel body 3) in the actual operation range. In the actual operation range, the swivel speed is controlled based on an ordinary swivel speed command. When the operator operates the operation lever, a speed command corresponding to the operation amount is generated, and a torque command for the electric swivel motor is generated based on the speed command. The electric swivel motor 21 is driven by the torque command to cause the upper-part swivel body to swivel. Referring to FIG. 5, a broken line indicates a transition of the swivel speed caused by the speed command corresponding to the lever operation amount in a case of a hydraulic swivel motion, a two-dot chain line indicates a transition of the swivel speed in a conventional motor swivel motion, and a solid line indicates a transition of the swivel speed in a motor swivel motion of this embodiment. Referring to FIG. 5, the gradients of the lines indicative of the speed correspond to the acceleration. In the example illustrated in FIG. 5, the operation amount of the operation lever is maximized, and the swivel speed reaches the maximum swivel speed Vmax.

Referring to FIG. 5, in the actual operation range, the speed command corresponding to the operation amount of the operation lever is generated. The transition of the swivel speed in the case of the motor swivel motion substantially conforms to the transition of the swivel speed in the case of the conventional motor swivel motion, also to the transition of the swivel speed in the case of the motor swivel motion of this embodiment, and also to the transition of the swivel speed in the case of the hydraulic swivel motion of this embodiment. Said differently, in the actual operation range, the actual swivel accelerations in the conventional motor swivel motion and in the motor swivel motion of this embodiment are substantially equal to the swivel acceleration by the speed command corresponding to the operation amount of the operation lever. Referring to FIG. 5, the swivel acceleration a in the conventional motor swivel motion is indicated by the gradient of the transition of the swivel speed.

Figure 6:
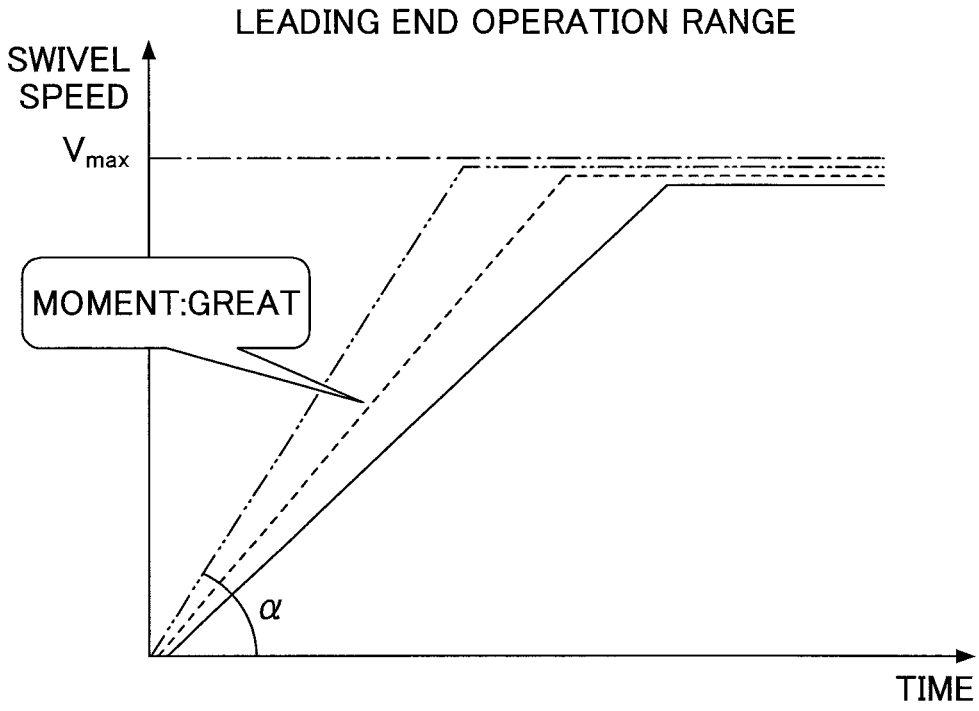
FIG. 6 is a graph illustrating a swivel speed of an upper-part swivel body in a leading end operation range.

FIG. 6 is a graph illustrating the swivel speed of the bucket 6 (namely, the upper-part swivel body 3) in the leading end operation range. Referring to FIG. 6, in a manner similar to FIG. 5, a broken line indicates a transition of the swivel speed caused by the speed command corresponding to the lever operation amount in a case of the hydraulic swivel motion, a two-dot chain line indicates a transition of the swivel speed in the conventional motor swivel motion, and a solid line indicates a transition of the swivel speed in the motor swivel motion of this embodiment. In the case of the conventional motor swivel motion, in the leading end operation range, the acceleration a being the same as the swivel acceleration in the actual operation range is set. Therefore, even though the bucket 6 swivels at a position relatively far from the cabin 10, the operator feels that the swivel speed is fast. Then, the operator resultantly feels that it is hard to perform a swivel operation. Therefore, in the case of the motor swivel motion of this embodiment, the swivel acceleration is set smaller than the swivel acceleration αof the conventional motor swivel motion and the bucket 6 is swiveled at an acceleration smaller than an acceleration corresponding to the lever operation. Thus, a comfortable operability is provided to the operator. In the case of the hydraulic swivel motion, the swivel acceleration of the bucket 6 in the leading end operation range is smaller than the acceleration in the actual operation range because the moment is great.

Figure 7:
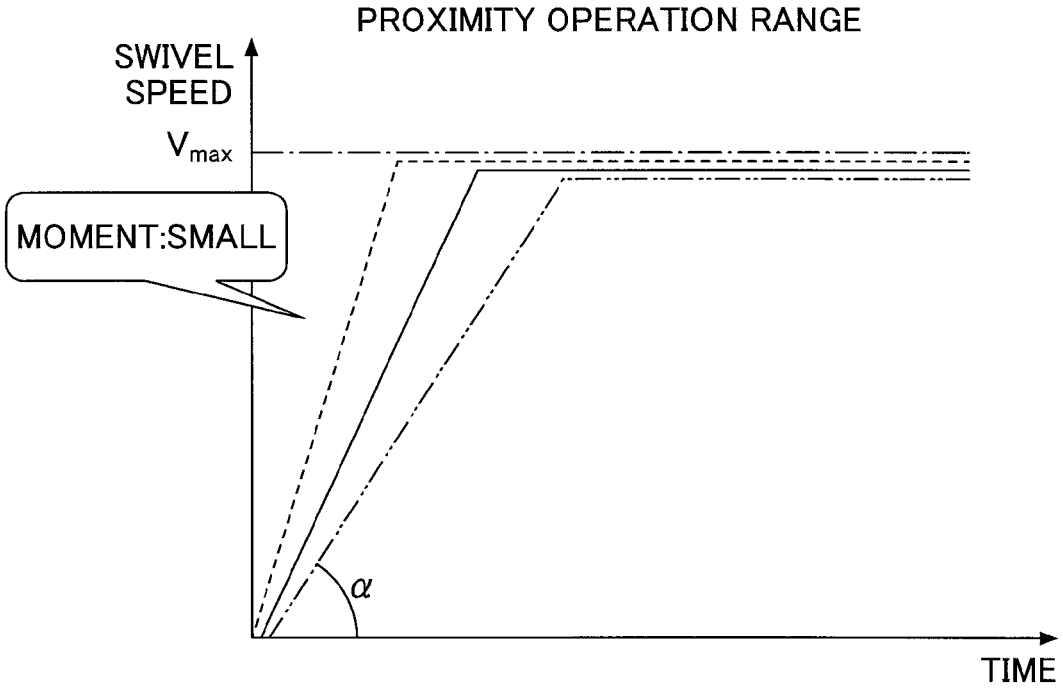
FIG. 7 is a graph illustrating a swivel speed of an upper-part swivel body in a proximity operation range.

FIG. 7 is a graph illustrating the swivel speed of the bucket 6 (namely, the upper-part swivel body 3) in the proximity operation range. Referring to FIG. 7, in a manner similar to FIG. 5, a broken line indicates a transition of the swivel speed caused by the speed command corresponding to the lever operation amount in a case of the hydraulic swivel motion, a two-dot chain line indicates a transition of the swivel speed in the conventional motor swivel motion, and a solid line indicates a transition of the swivel speed in the motor swivel motion of this embodiment. In the case of the conventional motor swivel motion, in the proximity operation range, the acceleration a being the same as the swivel acceleration in the actual operation range is set. Therefore, even though the bucket 6 swivels at a position relatively near from the cabin 10, the operator feels that the swivel speed is slow. Therefore, in the case of the motor swivel motion of this embodiment, the swivel acceleration is set greater than the swivel acceleration αof the conventional motor swivel motion and the bucket 6 is swiveled at an acceleration greater than an acceleration corresponding to the lever operation. Thus, a nimble operational feeling is provided to the operator. In the case of the hydraulic swivel motion, the swivel acceleration of the bucket 6 in the leading end operation range is very greater than the acceleration in the actual operation range because the moment is small.

Next, a swivel acceleration control of this embodiment is described. The deceleration control at a time of decelerating the swivel motion is similar to an acceleration control at a time of accelerating the swivel motion. Here, only the acceleration control at the time of accelerating the swivel motion is described.

Figure 8:
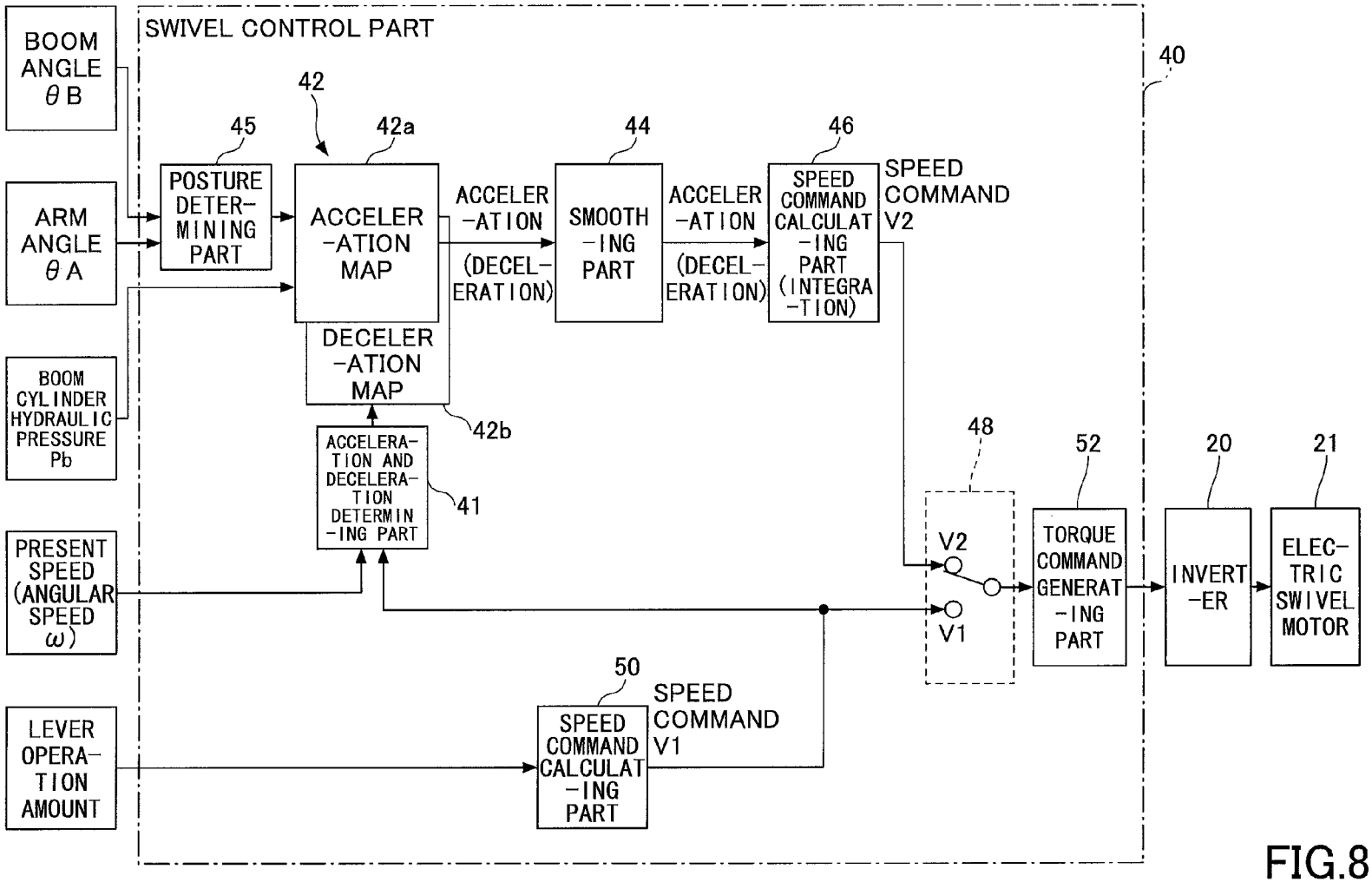
FIG. 8 is a functional block chart of a swivel control part that generates a torque command from an acceleration and deceleration map.

The swivel acceleration control of this embodiment is performed by the swivel control part 40 of the controller 30. FIG. 8 is a functional block chart of the swivel control part 40 that generates a torque command from an acceleration and deceleration map. The swivel control part 40 includes the acceleration and deceleration determining part 42, inside which a predetermined acceleration map 42*a* and a predetermined deceleration map 42*b* are stored. The acceleration map 42*a* (the deceleration map 42*b*) is a map indicative of a relationship among various postures of the boom 4 and the arm 5 and the swivel acceleration (the swivel deceleration). Within this embodiment, the postures of the boom 4 and the arm 5 are indicated by the boom angle θB and the arm angle θA. The signals detected by the boom angle sensor 7B and the arm angle sensor 8A are input into the posture determining part 45. The posture of the attachment is determined by a posture determining 45, and the result of the determination is input into the acceleration map 42*a*. The swivel acceleration determined with reference to the acceleration map 42*a* is output from the acceleration and deceleration determining part 42. After the swivel acceleration is smoothed by a smoothing part 4, the smoothed swivel acceleration is supplied to a speed command calculating part 46. The acceleration and deceleration determining part 41 compares a present speed (an angular speed ω) with a first speed command V1 output from the speed command calculating part 50 to determine whether the swivel motion is accelerating or decelerating. The determined result is sent to the acceleration and deceleration determining part 42. The acceleration and deceleration determining part 42 refers to the acceleration map 42*a* based on the determined result of whether the swivel motion is accelerating or decelerating. If the swivel motion is accelerating, the acceleration map 42*a* is referred to, and if the swivel motion is decelerating, the deceleration map 42*a* is referred to. A speed command calculating part as a second swivel drive command generating portion 46 generates a second speed command V2 (a second swivel drive command) from a swivel acceleration supplied from a smoothing part 44 and outputs the generated second speed command V2 to a switch part 48.

Meanwhile, the swivel control part 40 includes a speed command calculating part 50 as a first swivel drive command generating portion. The speed command calculating part 50 generates a first speed command V1 (a first swivel drive command) from a lever operation amount of the swivel operation lever and outputs the generated first speed command V1 to the switch part 48.

The switch part 48 for switching over the drive signal compares the second speed command supplied from the speed command calculating part 46 with the first speed command V1 supplied from the speed command calculating part 50 and determines which of the first speed command V1 and the second speed command V2 is smaller. In this case, the speed command value has a positive or negative sign depending on a swivel direction. Therefore, absolute values of the first speed command V1 and the second speed command V2 are used to compare the first speed command V1 with the second speed command V2. In a case where the second speed command V2 is smaller than the first speed command V1, the second speed command V2 is selected and output to a torque command generating part 52. In a case where the second speed command V2 is equal to or greater than the first speed command V1, the switch part 48 selects the first speed command V1 and outputs it to the torque command generating part 52.

The torque command generating part 52 generates the torque command from the supplied first and second speed commands V1 and V2, and outputs the generated torque command. The torque command output from the torque command generating part 52 is supplied to an inverter 20 that controls the drive of the electric swivel motor 21. The inverter 20 drives the electric swivel motor 21 based on the supplied torque command. Therefore, the swivel acceleration of the upper-part swivel body 3 that is driven by the electric swivel motor 21 is determined by the torque command output from the torque command generating part 52.

As described above, the acceleration is determined based on the posture of the attachment. Therefore, regardless of whether the swivel motion is a single operation or a complex operation that is performed along with an operation of the attachment, a stable swivel motion can be substantialized.

An example of a swivel control performed by the swivel control part 40 is further described.

In addition to the boom angle θB and the arm angle θA, a hydraulic pressure Pb of the boom cylinder 7 on the bottom side and a present revolution speed (an angular speed ω) of the electric swivel motor 21 are supplied to the swivel control part 40. The boom angle θB and the arm angle θA represent the posture of the boom 4 and the arm 5 whether the boom 4 and the arm 5 are opened so as to extend or closed so as to fold.

The hydraulic pressure of the boom cylinder on the bottom side how much a load is applied to the attachment. When a great amount of earth and sand are loaded (during heavy work) in the bucket, the earth and sand may be easily spilled out when the swivel motion is a sudden acceleration or deceleration. Therefore, the hydraulic pressure Pb of the boom cylinder 7 on the bottom side is input into an acceleration map 42*a* and the deceleration map 42*b*. With this, the acceleration and the deceleration of the swivel motion are adjusted in consideration of the load applied to the attachment.

The present revolution speed (an angular speed ω) of the electric swivel motor 21 may be used as a trigger for changing the swivel acceleration as described below.

Figure 9:
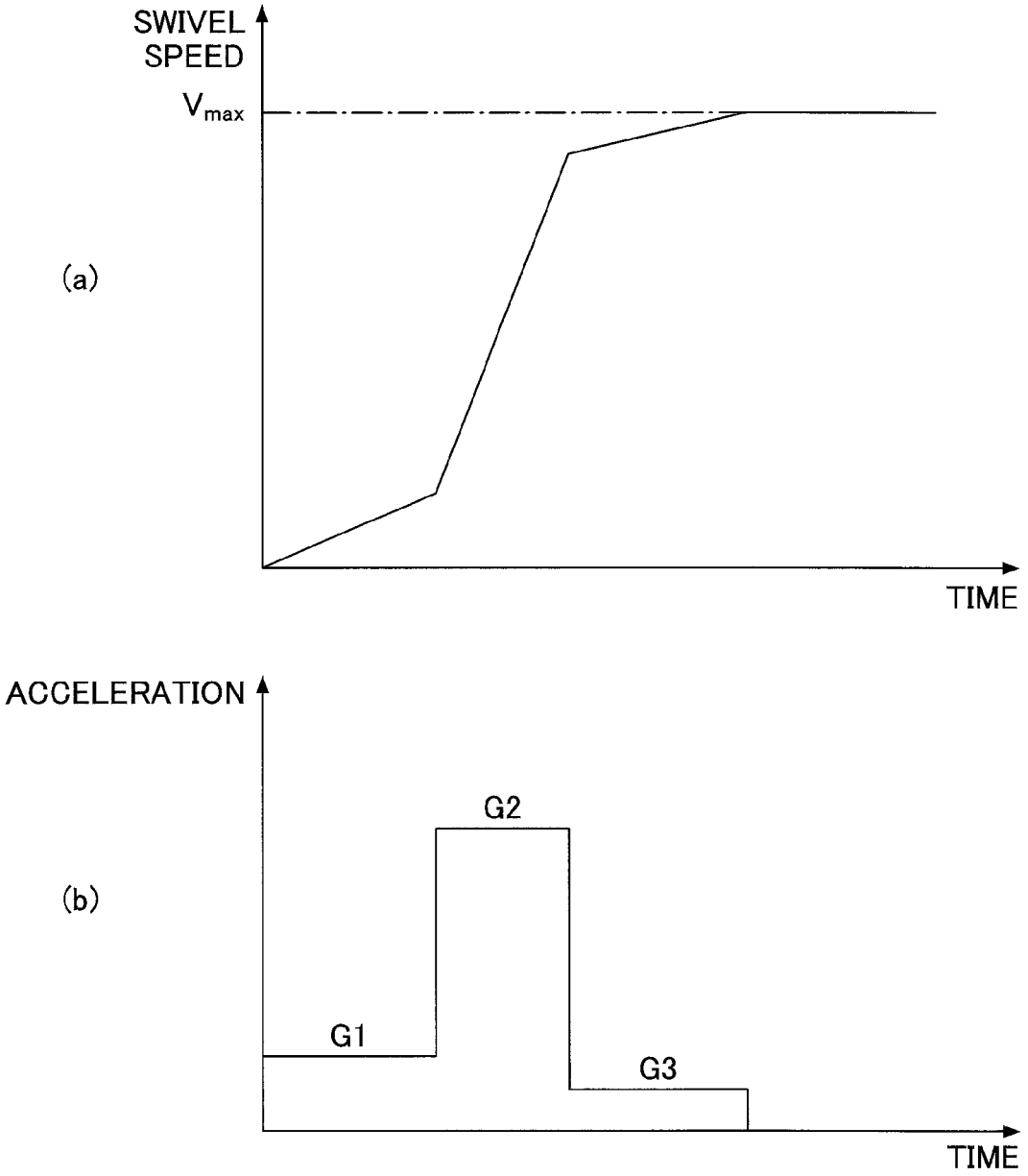
FIG. 9 illustrates an acceleration map stored in the swivel control part.

FIG. 9 illustrates, in (a) and (b), an acceleration map 42*a* in the actual operation range stored in the swivel control part 40. FIG. 9 illustrates, in (a), a graph corresponding to the acceleration map in performing the swivel motion in a case where the bucket 6 exists in the actual operation range. FIG. 9 illustrates, in (a), a graph illustrating a transition of the swivel speed in a case where the acceleration is changed as illustrated in (b) of FIG. 9.

The acceleration map 42*a* illustrates a relationship between the postures of the boom 4 and the arm 5 and the acceleration to be output. When the boom angle θB and the arm angle θA are input into the acceleration and deceleration determining part 42 as information of the posture, the acceleration and deceleration determining part 42 outputs the acceleration suitable for the boom 4 and the arm 5 with reference to the acceleration map 42*a*.

For example, when the position of the bucket 6 is determined to be within the actual operation range based on the postures of the boom 4 and the arm 5, which are determined by the boom angle θB and the arm angle θA, the acceleration map 42*a* indicative of the acceleration in the actual operation range is referred to. The acceleration obtained from the acceleration map 42*a* is output from the acceleration and deceleration determining part 42. The height of the acceleration illustrated in (b) of FIG. 9 is indicated in the acceleration map 42*a*.

According to the graph illustrated in (b) of FIG. 9, a small acceleration G1 is firstly output, a higher acceleration G2 is applied after a predetermined period, and a very small acceleration G3 is finally applied. According to the acceleration pattern, a transition of the swivel speed becomes as illustrated in (a) of FIG. 9. Said differently, before the swivel speed increases up to a speed instructed by the speed command, the acceleration G1 is firstly applied to slowly accelerate the swivel motion. After the swivel speed increases to reach a certain speed, a great acceleration G2 is applied. The acceleration G2 is high enough to prevent the operator from feeling discomfort. The very small acceleration G3 s applied immediately before reaching the swivel speed corresponding to the speed command. In the example illustrated in (a) and (b) of FIG. 9, the operation amount of the swivel operation lever becomes the maximum. The swivel speed becomes the maximum swivel speed Vmax.

Figure 10:
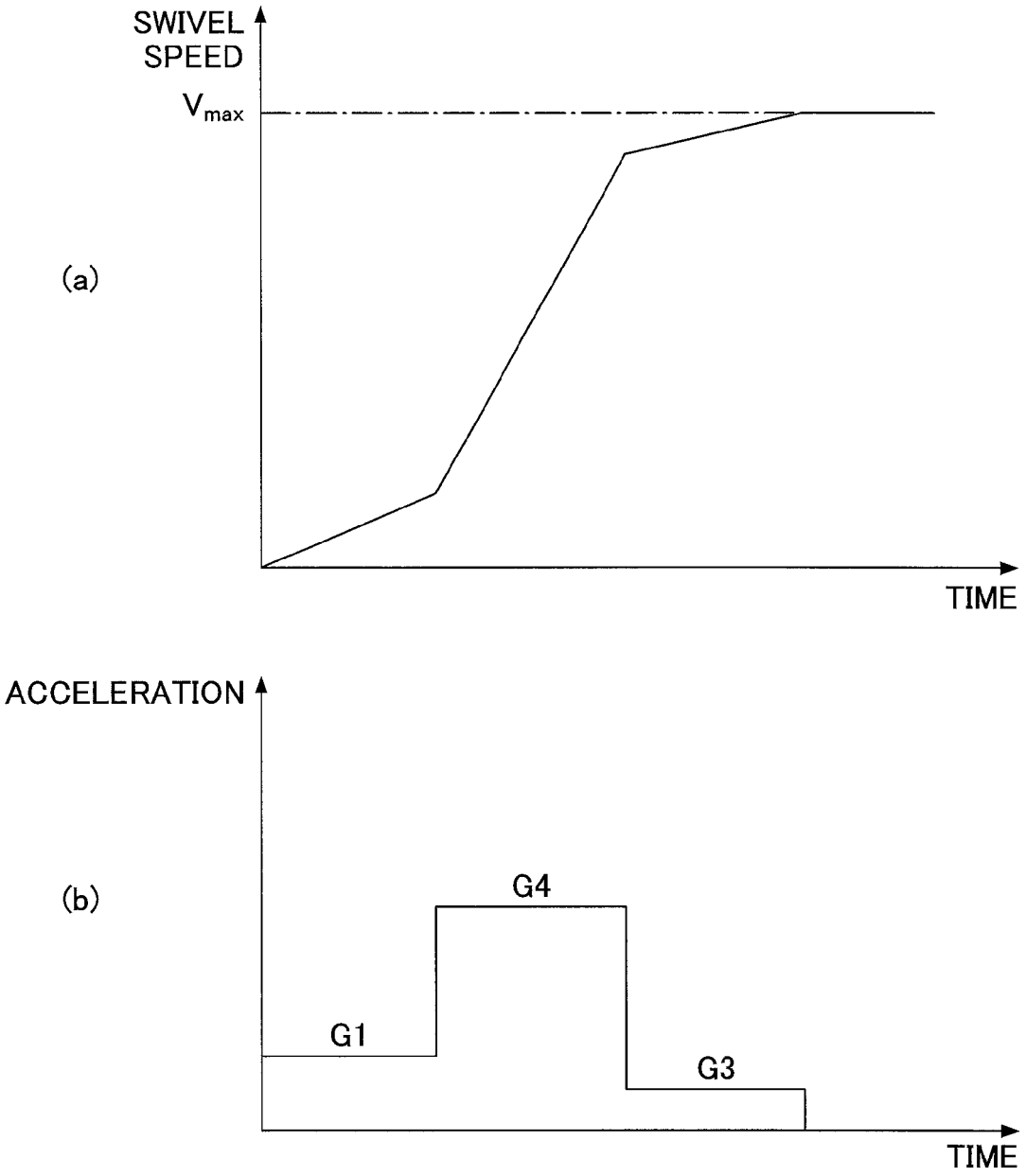
FIG. 10 illustrates an acceleration map in the leading end operation range stored in the swivel control part.

FIG. 10 illustrates, the acceleration map 42*a* in the leading end operation range stored in the swivel control part 40. Referring to (b) of FIG. 10, a graph corresponding to the acceleration map in performing the swivel motion in a case where the bucket 6 exists in the leading end operation range is illustrated. FIG. 10 illustrates, in (a), a graph illustrating a transition of the swivel speed in a case where the acceleration is changed as illustrated in (b) of FIG. 10.

For example, when the position of the bucket 6 is determined to be within the leading end operation range based on the postures of the boom 4 and the arm 5, which are determined by the boom angle θB and the arm angle θA, the acceleration map 42*a* indicative of the acceleration in the leading end operation range is referred to. The acceleration obtained from the acceleration map 42*a* is output from the acceleration and deceleration determining part 42. The height of the acceleration illustrated in (b) of FIG. 10 is indicated in the acceleration map 42*a*.

According to the graph illustrated in (b) of FIG. 10, a small acceleration G1 is firstly output, a higher acceleration G4 is applied after a predetermined period, and a very small acceleration G3 is finally applied. According to the acceleration pattern, a transition of the swivel speed becomes as illustrated in (a) of FIG. 10. Said differently, before the swivel speed increases up to a speed instructed by the speed command, the acceleration G1 is firstly applied to slowly accelerate the swivel motion. After the swivel speed increases to reach a certain speed, a great acceleration G4 is applied. The acceleration G4 is high enough to prevent the operator from feeling discomfort. The very small acceleration G3 is applied immediately before reaching the swivel speed corresponding to the speed command. The reason why the acceleration G3 is applied is to smoothly changes the acceleration with respect to the swivel speed corresponding the command. In the example illustrated in (a) and (b) of FIG. 10, the operation amount of the swivel operation lever becomes the maximum. The swivel speed becomes the maximum swivel speed Vmax.

The acceleration G4 illustrated in (b) of FIG. 10 is the swivel acceleration in the leading end operation range and is set smaller than the acceleration G2 in the actual operation range in (b) of FIG. 9. Therefore, the swivel acceleration in a case where the bucket 6 is inside the leading end operation range, the bucket 6 is set to be a value smaller than the swivel acceleration in the case where the bucket 6 is within the ordinary operation range. With this, there is no uncomfortable feeling for the operator, and comfortable operational feeling can be provided to the operator.

There is a case where the bucket 6 enters into a different operation range during the swivel motion. In this case, it is possible to determine that the bucket 6 enters a different range from the postures of the boom 4 and the arm 5. If it is determined that the bucket 6 transits to the different range, the acceleration map 42*a* to be referred to is change to that in the operation range before the transition to the operation range after the transition.

For example, in a case where the bucket 6 transits from the actual operation range to the leading end operation range during the swivel motion, the referred acceleration map is switched from the acceleration map illustrated in (b) of FIG. 10 to the acceleration map illustrated in (b) of FIG. 9 during the swivel motion.

Figure 11:
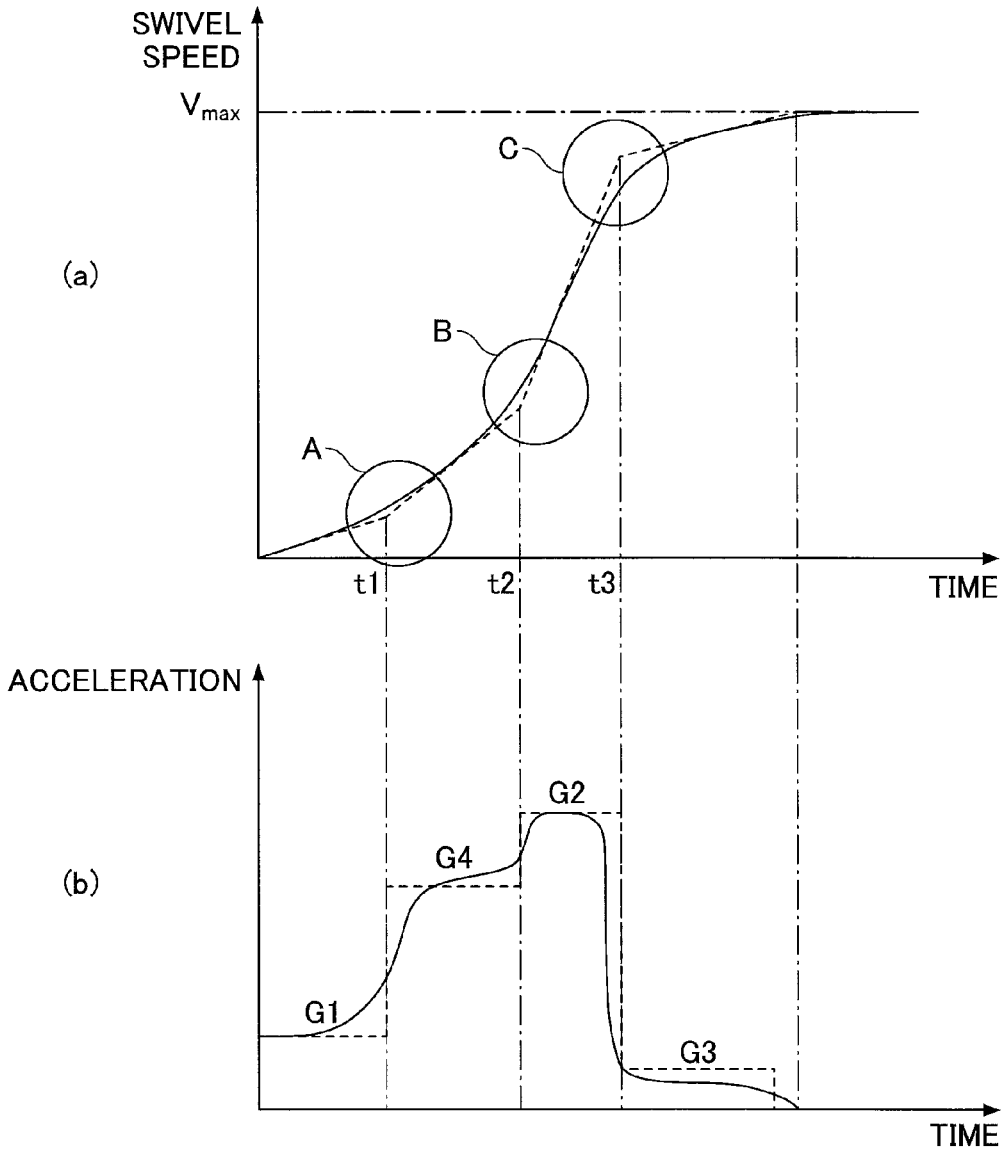
FIG. 11 illustrates a transition of the swivel speed and a change of the acceleration when the bucket moves from the ordinary operation range to the leading end operation range during a swivel motion.

FIG. 11 illustrates, in (a) and (b), a transition of the swivel speed and a change of the acceleration when the bucket moves from the actual operation range to the leading end operation range during the swivel motion. In the example illustrated in (a) and (b) of FIG. 11, the bucket 6 transits from the leading end operation range to the actual operation range at a time t2. As illustrated in (b) of FIG. 11, the acceleration and deceleration determining part switches the acceleration map 42*a* referred to at the time t2 from the acceleration map illustrated in (b) of FIG. 10 to the acceleration map illustrated in (b) of FIG. 9 and outputs the acceleration. Therefore, as indicated by the broken line of (b) of FIG. 11, the acceleration G4 obtained from the acceleration map in the leading end operation range is output before the time t2. After the time t2, the acceleration G2 obtained from the acceleration map illustrated in (b) of FIG. 9 in the leading end operation range is output.

A change of the acceleration provided with smoothing by the smoothing part 44 is indicated by a solid line in (b) of FIG. 11. Because an impact occurs at a step-wise change of the acceleration, the smoothing part 44 is provided to smooth the change of the acceleration in order to prevent the impact from occurring. The smoothing part 44 functions as an interpolation operating part that smoothes the acceleration by an interpolation operation. By providing the smoothing by the smoothing part 44, the swivel speed smoothly changes as illustrated in (a) of FIG. 11. With this, it is possible to prevent the impact caused by the change of the acceleration from occurring.

In the smoothing at a part A of (a) of FIG. 11, the change of the acceleration G1 to the acceleration G4 at the time t1 (the change of the acceleration in one acceleration map) is smoothed. Similarly, in the smoothing at a part C of (a) of FIG. 11, the change of the acceleration G2 to the acceleration G3 at a time t3 (the change of the acceleration in one acceleration map) is smoothed. In the smoothing at a part B of (a) of FIG. 11, the change of the acceleration G4 to the acceleration G2 at a time t2 when the acceleration map in the leading end operation range is switched to the acceleration map in the actual operation range is smoothed.

In the above example, the accelerations in the leading end operation range and the proximity operation range are variably controlled. By preparing the acceleration maps corresponding to the upper part operation range and the lower part operation range, even in a case where the bucket 6 (the end attachment) is in the upper part operation range or the lower part operation range, in a manner similar to the leading end operation range or the proximity operation range, the acceleration can be variably changed to provide comfortable operability. Whether the bucket 6 is in the upper part operation range or the lower part operation range can be determined from the boom angle θB and the arm angle θA. Even when the position of the attachment is changed through multiple operation ranges, if the swivel acceleration smoothly changes, it is not always necessary to perform the smoothing. Thus, the smoothing part 44 may be provided when necessary.

Further, within the above described embodiment, the acceleration is obtained from the acceleration map, the speed command is obtained by converting the acceleration to a speed, and the speed command is converted to the torque command. A torque map indicative of a relationship between the postures of the boom and the arm in each operation range and a torque command value may be prepared. Instead of the acceleration map 42*a* and the deceleration map 42*b*, the torque map may be used to directly obtain a torque command value.

Figure 12:
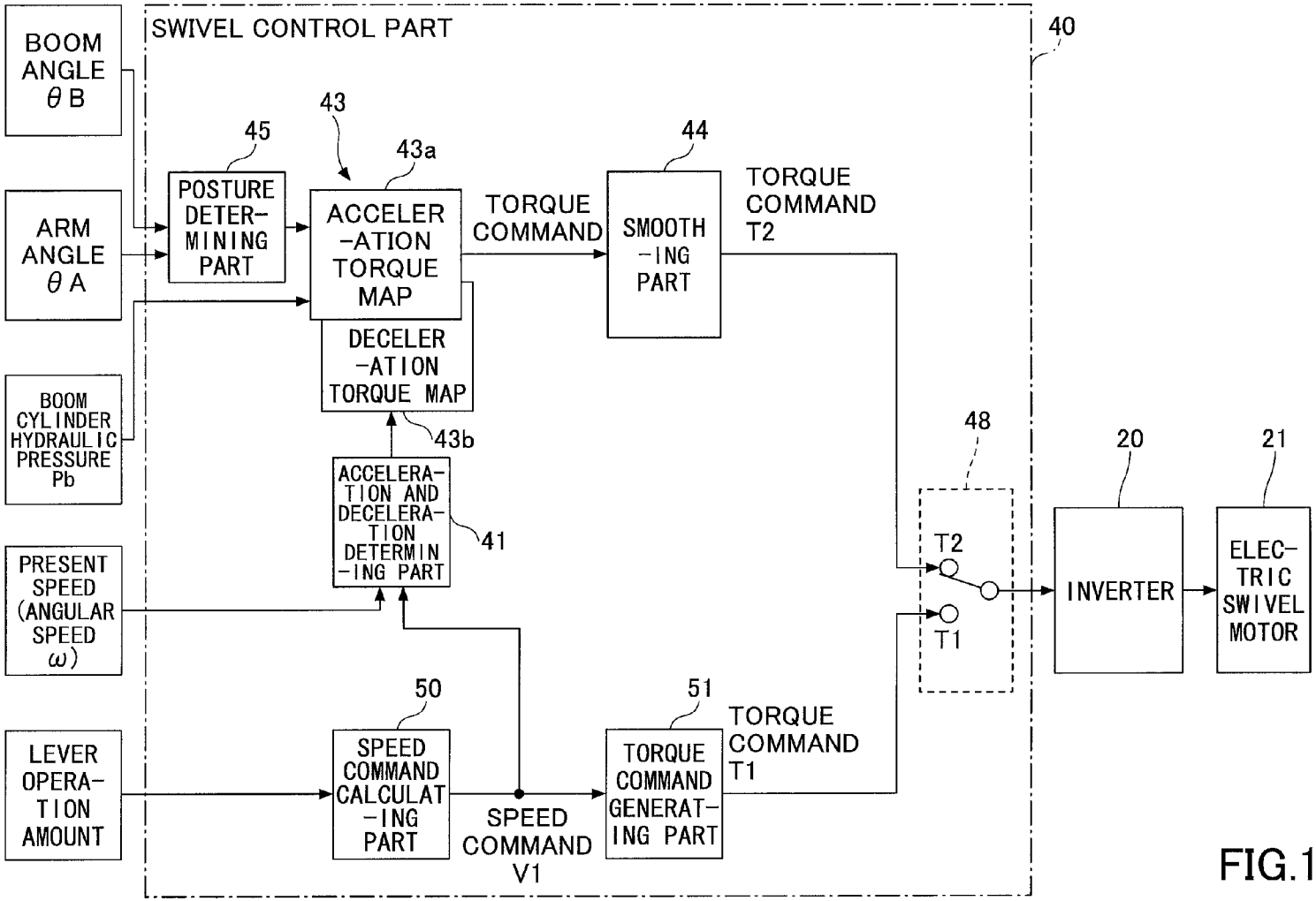
FIG. 12 is a functional block chart of a swivel control part, by which a torque command value is obtained using a torque map.

FIG. 12 is a functional block chart of the swivel control part 40, which obtains the torque command value using the torque map. The swivel control part 40 includes a torque determining part 43, inside which a prepared acceleration torque map 43*a* and a deceleration torque map 43*b* are stored. The acceleration torque map 43*a* (the deceleration torque map 42*b*) is a map indicative of a relationship among various postures of the boom 4 and the arm 5 and the swivel torque. Within this embodiment, the postures of the boom 4 and the arm 5 are indicated by the boom angle θB and the arm angle θA.

The acceleration torque determined by referring to the acceleration torque map 43*a* is output from the torque determining part 43, is subjected to smoothing by the smoothing part 44, and is output to the switch part 48. The acceleration and deceleration determining part 41 compares a present speed (an angular speed ω) with the first speed command V1 output from the speed command calculating part 50 to determine whether the swivel motion is accelerating or decelerating. The determined result is sent to the torque determining part 43. The torque determining part 43 refers to the acceleration map 43*a* based on the determined result of whether the swivel motion is accelerating or decelerating. If the swivel motion is accelerating, the acceleration torque map 43*a* is referred to, and if the swivel motion is decelerating, the deceleration torque map 43*b* is referred to. The second torque command T2 (a second swivel drive command) output from the smoothing part 44 is supplied to the switch part 48. In the swivel control part 40 illustrated in FIG. 12, a second swivel drive command generating portion includes the acceleration and deceleration determining part 41 and the torque determining part 43.

On the other hand, the swivel control part 40 includes a speed command calculating part 50 and a torque command generating part 51 as a first swivel drive command generating portion. The speed command calculating part 50 generates a first speed command V1 (a first swivel drive command) from a lever operation amount of the swivel operation lever and outputs the generated first speed command V1 to the torque command generating part 51. The torque command generating part 51 generates a first torque command (a first swivel drive command) based on the first speed command V1 supplied from the speed command calculating part 50 and a present speed of the upper-part swivel body 3, and outputs the first torque command to the switch part 48.

The switch part 48 for switching over the drive signal compares the second torque command T2 supplied from the torque determining part 43 through the smoothing part 44 with the first torque command T1 supplied from the torque command generating part 51 and determines which of the second torque command T2 and the first torque command T1 is smaller. In a case where the second torque command T2 is smaller than the first torque command T1, the second torque command T2 is selected and output to an inverter 20. In a case where the second torque command T2 is equal to or greater than the first torque command T1, the first torque command T1 is selected and output to the inverter 20. The inverter 20 drives the electric swivel motor 21 based on the supplied torque command. Therefore, the swivel acceleration of the upper-part swivel body 3 that is driven by the electric swivel motor 21 is determined by the torque command output from the switch part 48. As described above, the torque command is determined based on the posture of the attachment. Therefore, regardless of whether the swivel motion is the single operation or the complex operation that is performed along with the operation of the attachment, the stable swivel motion can be substantialized.

Next, a second embodiment of the present invention is described.

Within the second embodiment described below, the swivel speed of the end attachment (the upper-part swivel body 3) is controlled by correcting the swivel speed command based on the swivel radius R of the end attachment.

Figure 13:
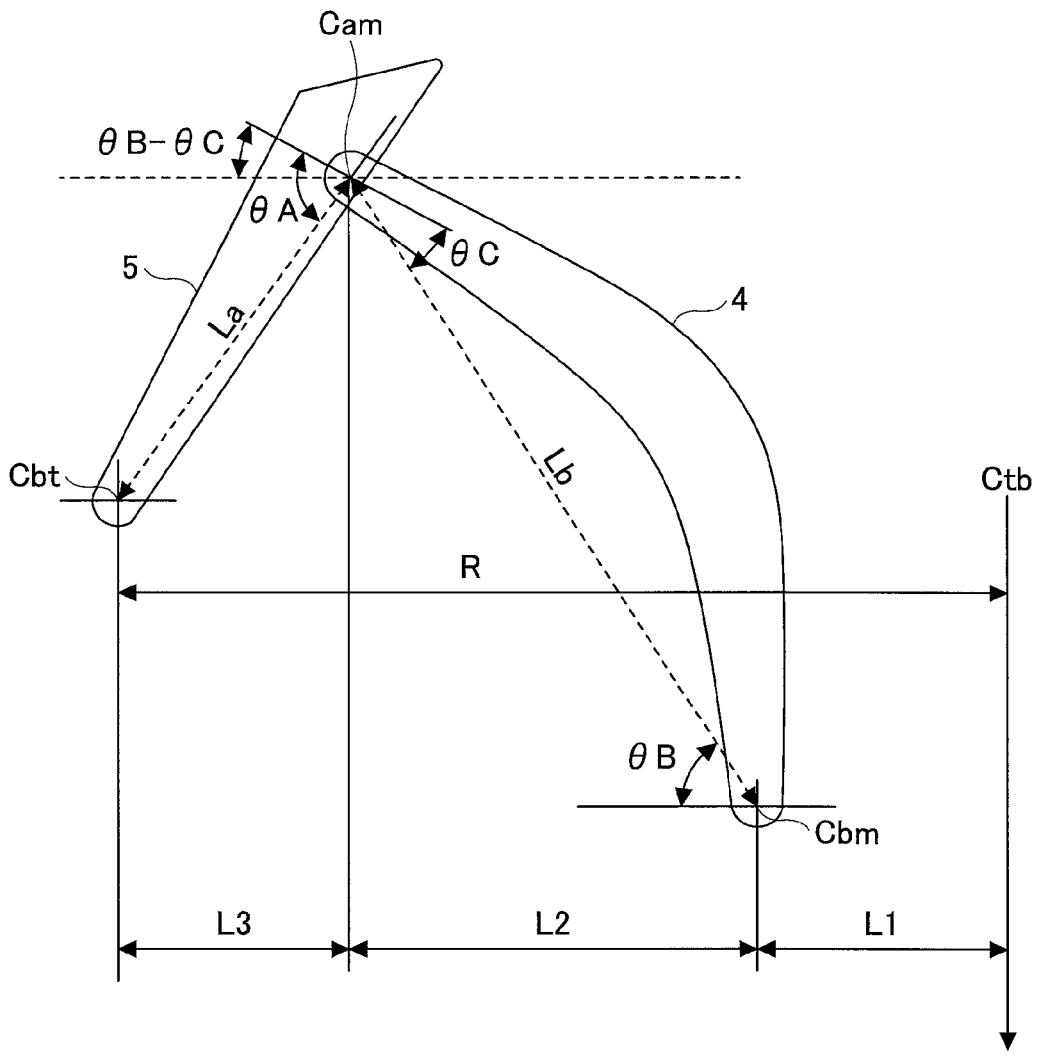
FIG. 13 explains a swivel radius of an end attachment.

FIG. 13 illustrates the swivel radius of the end attachment. Referring to FIG. 13, the boom 4 and the arm 5 attached to the leading end of the boom 4 are illustrated. The bucket 6 as the end attachment is attached to the leading end of the arm 5. The position of the end attachment is at the leading end of the arm, to which the bucket 6 is attached.

Referring to FIG. 13, a distance from a rotational center Cbm of the boom 4 to a rotational center Cam of the arm 4 is a boom length Lb. A distance from the rotational center Cam of the arm 4 to a rotational center of the bucket 6 is an arm length La. Because the boom 4 is attached to the upper-part swivel body 3, the boom 4, the arm 5, and the bucket 6 swivels around a swivel center Ctb of the upper-part swivel body 3. Therefore, the swivel radius R of the end attachment (the bucket 6) can be expressed as a distance between the swivel center Ctb of the upper-part swivel body 3 and the rotational center Cbt of the bucket.

In consideration of a case where the shovel is horizontally positioned, a distance L1 from the swivel center Ctb of the upper-part swivel body 3 to the rotational center Cbm in the horizontal direction is a known value. A distance L2 from the rotational center Cbm of the boom 4 to the rotational center Cam of the arm 5 in the horizontal direction can be obtained as $Lb \times \cos \theta B$ using the length Lb of the boom 4 and the boom angle θB. A distance L3 from the rotational center Cam of the arm 5 to the rotational center Cbt of the bucket 6 in the horizontal direction can be obtained as $La \times \cos(\theta A-(\theta B-\theta C))$ using the length La of the arm 5, the arm angle θA, and a bent angle θC of the boom 4.

The swivel radius R is obtained by adding the distance $L2=Lb \times \cos \theta B$ and the distance $L3=La \times \cos(\theta A-(\theta B-\theta C))$ to the distance L1 as $R=L1+Lb \times \cos \theta B+La \times \cos(\theta A-(\theta B-\theta C))$. The distance L1, the boom length Lb, the arm length La, and the boom bent angle θC are known values. The swivel radius R can be obtained by substituting the boom angle θA detected by the boom angle sensor 7B and the arm angle θB detected by the arm angle sensor 8A with those detected by the boom angle sensor 7B and the arm angle sensor 8A.

The above swivel radius R is changed by the postures of the boom 4 and the arm 5. Said differently, the swivel radius R is changed by the boom angle θB being a tilt angle of the boom 4 and the boom angle θA being a tilt angle of the arm 5. As the boom angle θB becomes smaller, the swivel radius R becomes greater. As the arm angle θA becomes smaller, the swivel radius R becomes greater. When the boom angle θB and the arm angle θA is the minimum, the swivel radius R becomes the maximum. Said differently, when both of the boom angle θB and the arm angle θA are the minimum, the end attachment (the bucket 6) is positioned at the farthest position from the swivel center Ctb of the upper-part swivel body 3. On the contrary, when both of the boom angle θB and the arm angle θA are the maximum, the end attachment (the bucket 6) is positioned at the closest position from the swivel center Ctb of the upper-part swivel body 3. As described, the swivel radius R can be used as a parameter indicative of the position of the end attachment (the bucket 6).

Within this embodiment, the speed command value is corrected based on the swivel radius R. Therefore, in a manner similar to the first embodiment, the swivel speed or the swivel acceleration are variably controlled to thereby provide a comfortable operability.

Figure 14:
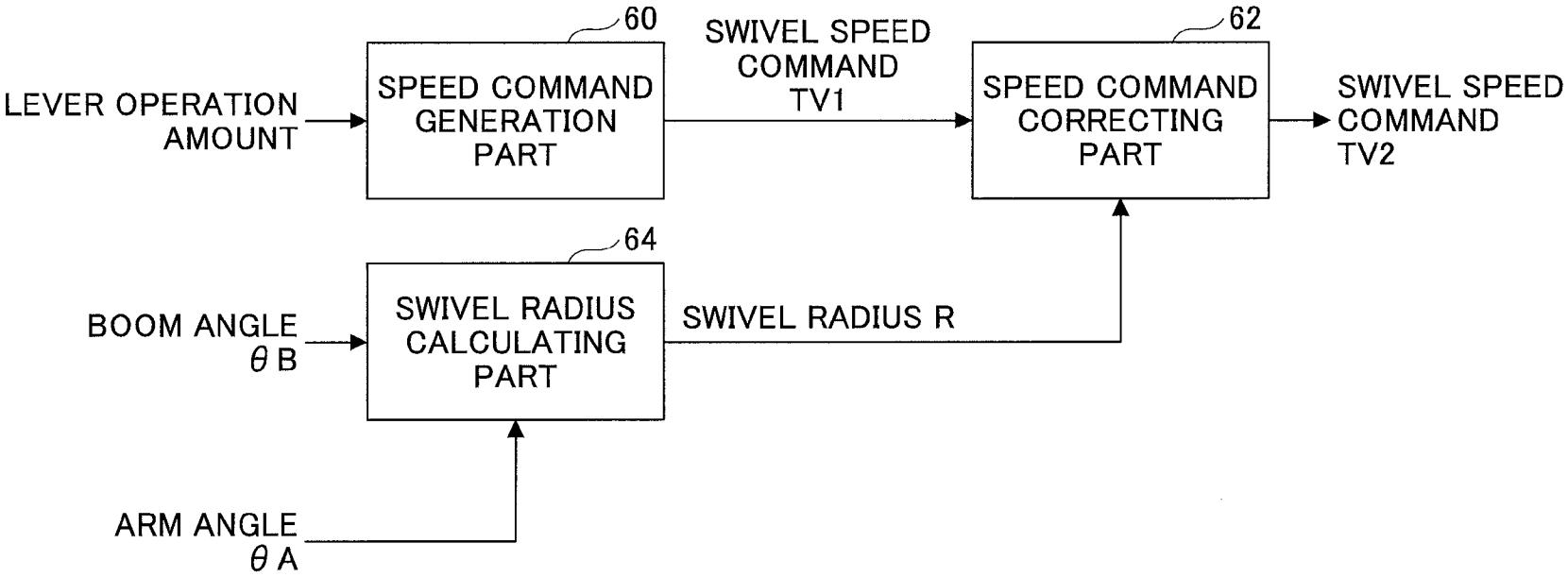
FIG. 14 is a block chart of a correction function of a swivel speed command (a swivel drive command) of a second embodiment.

FIG. 14 is a block chart of the correction function of the swivel speed command (the swivel drive command) of this embodiment. Ordinarily, the swivel speed command as an example of the swivel drive command is generated by the lever operation amount of the swivel operation lever. Referring to FIG. 14, the lever operation amount of the swivel operation lever is input into the speed command generating part 60. The speed command generating part 60 converts the lever operation amount to the swivel speed command, generates the swivel speed command TV1, and outputs the generated swivel speed command TV1.

Figure 15:
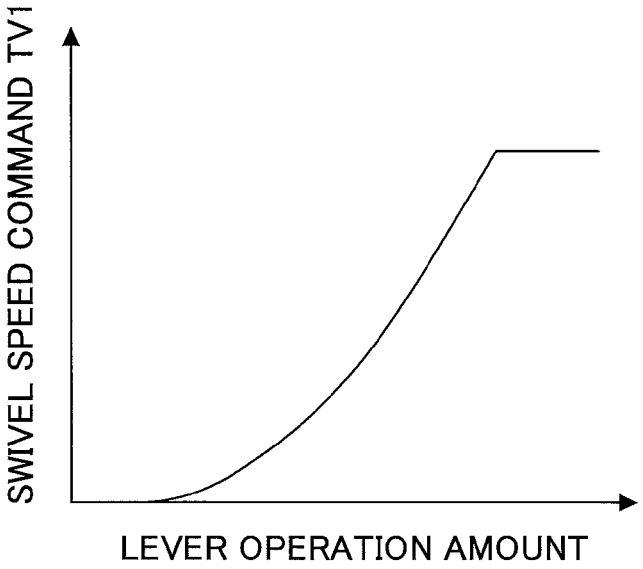
FIG. 15 is a graph illustrating a relationship between a lever operation amount and the swivel speed command.

FIG. 15 is a graph indicative of a relationship between the lever operation amount and the swivel speed command TV1. When the lever operation amount of the swivel operation lever becomes greater, the value of the swivel speed command TV1 becomes higher. Said differently, when the operator increases the lever operation amount to make the swivel speed higher (said differently, the swivel operation lever is greatly turned), the swivel speed command TV1 becomes higher and the revolution speed of the electric swivel motor becomes high. When the lever operation amount becomes great to a certain extent, the swivel speed command TV1 stops increasing to have a constant value.

The speed command generating part 60 includes a map as illustrated in FIG. 15. When the lever operation amount is input, the swivel speed command corresponding to the lever operation amount is generated and output as a swivel speed command TV1. The swivel speed command TV1 output from the speed command generating part 60 is input into the speed command correcting part 62.

On the other hand, the boom angle θB and the arm angle θA are input into the swivel radius calculating part 64. The swivel radius calculating part 64 calculates the swivel radius R of the end attachment from the boom angle θB and the arm angle θA, and outputs the calculated swivel radius R to the above speed command correcting part 62.

The speed command correcting part 62 corrects the swivel speed command V1 generated by the speed command generating part 60 based on the swivel radius R to generate the swivel speed command TV2, and outputs the generated swivel speed command TV2 to the electric swivel motor 21. Specifically, the speed command correcting part 62 multiplies the swivel speed command TV1 by the speed command ratio VR to correct the swivel speed command TV1 to be the swivel speed command TV2 ($TV2=TV1 \times VR$).

Figure 16:
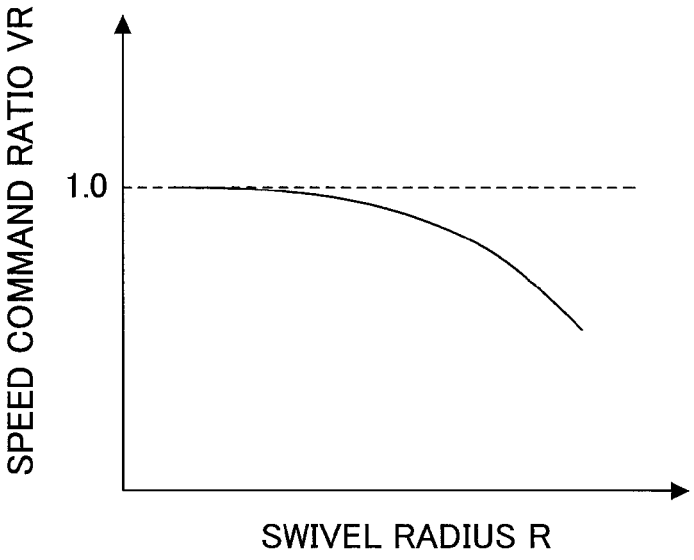
FIG. 16 is a graph illustrating a relationship between the swivel radius and the speed command.

The speed command ratio VR is a predetermined ratio equal to or less than 1.0. As illustrated in FIG. 16, as the swivel radius R becomes greater, the speed command ratio VR becomes smaller. When the swivel radius R is minimal (said differently, when the boom 4 and the arm 5 are completely folded), the speed command ratio VR is 1.0. Thus, the swivel speed command TV2 is equal to the swivel speed command TV1 and remains unchanged from the swivel speed command TV1 obtained from the lever operation amount. As the boom 4 and the arm 5 are opened to increase the swivel radius R, the speed command ratio VR is gradually decreased as illustrated in FIG. 16. Therefore, as the swivel radius R becomes greater, the swivel speed command TV2 corrected by the swivel radius R becomes smaller than the swivel speed command TV1.

As describe above, the swivel speed command TV2 corrected by multiplying the swivel speed command TV1, which is generated from the lever operation amount, by the speed command ratio RV is supplied to the electric swivel motor 21. With this, the swivel speed of the electric swivel motor 21 (i.e., the swivel speed of the upper-part swivel body 3 and the end attachment) is controlled by the swivel speed command TV2. Therefore, as the swivel radius R of the end attachment (the bucket 6) becomes greater, the swivel speed of the upper-part swivel body 3 is controlled to be smaller than the swivel speed controlled by the swivel speed command TV1.

Figure 17:
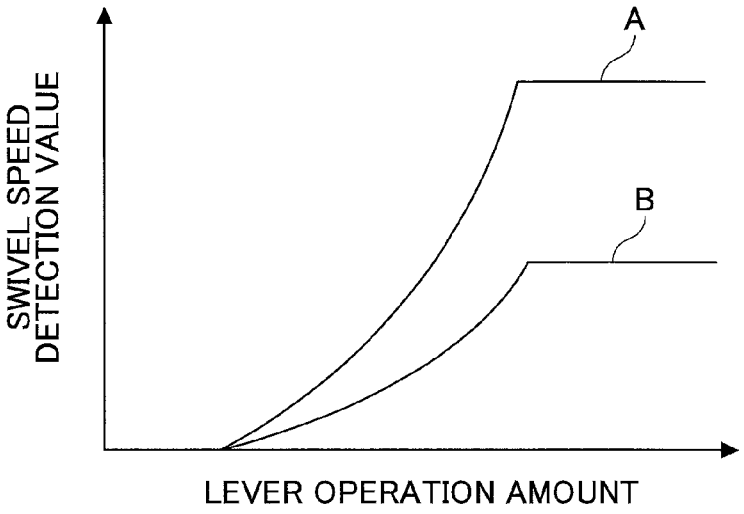
FIG. 17 is a graph illustrating a detection value of the swivel speed of the upper-part swivel body that is controlled by the swivel speed command after correcting the swivel speed command.

FIG. 17 is a graph illustrating a detection value of the swivel speed of the upper-part swivel body that is controlled by the swivel speed command TV2. The solid line A indicates a detection value of the swivel speed corresponding to the lever operation amount in a case where the swivel radius R is small. The solid line B indicates a detection value of the swivel speed corresponding to the lever operation amount in a case where the swivel radius R is great. By comparing the solid lines A and B, when the lever operation amount is the same, as the swivel radius R is greater, the swivel speed is controlled to be smaller. Therefore, as the boom 4 and the arm 5 open more, the swivel speed is controlled to be smaller. Along with this, the swivel acceleration until the swivel speed is gained becomes smaller. Therefore, proper operational feeling can be given to the operator.

Figure 18:
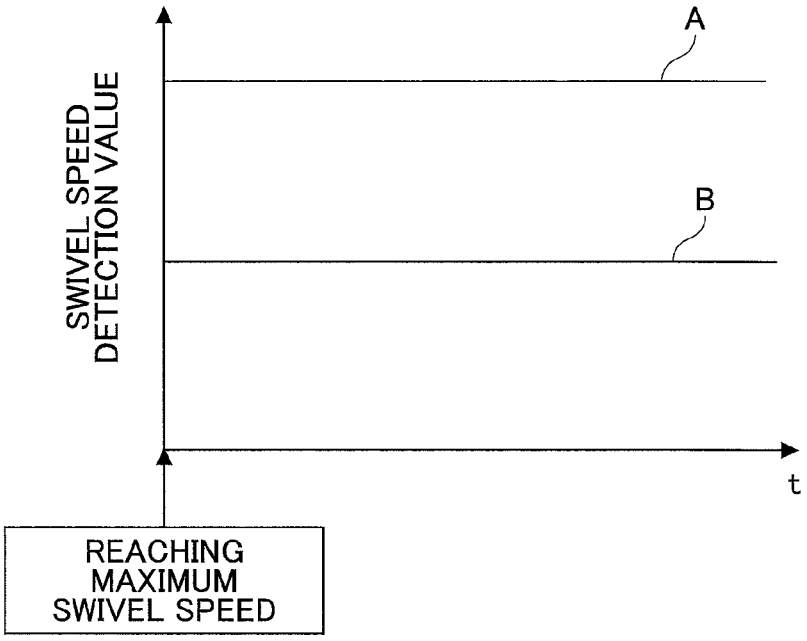
FIG. 18 is a graph illustrating a detection value of the maximum swivel speed of the upper-part swivel body that is controlled by the swivel speed command after correcting the swivel speed command.

After the swivel speed reaches the maximum speed corresponding to the lever operation amount, the swivel speed is maintained at the maximum speed while the lever operation amount is maintained as illustrated in FIG. 18. Referring to FIG. 18, the solid line A indicates that the swivel speed is maintained at the maximum swivel speed corresponding to the lever operation amount in a case where the swivel radius R is small. Referring to FIG. 18, the solid line B indicates that the swivel speed is maintained at the maximum swivel speed corresponding to the lever operation amount in a case where the swivel radius R is great.

As described above, within this embodiment, the swivel speed is variably controlled to provide a comfortable operability by correcting the swivel speed command TV1, which is an example of the swivel drive command, based on the swivel radius R to thereby variably control the swivel speed command TV1.

Figure 19:
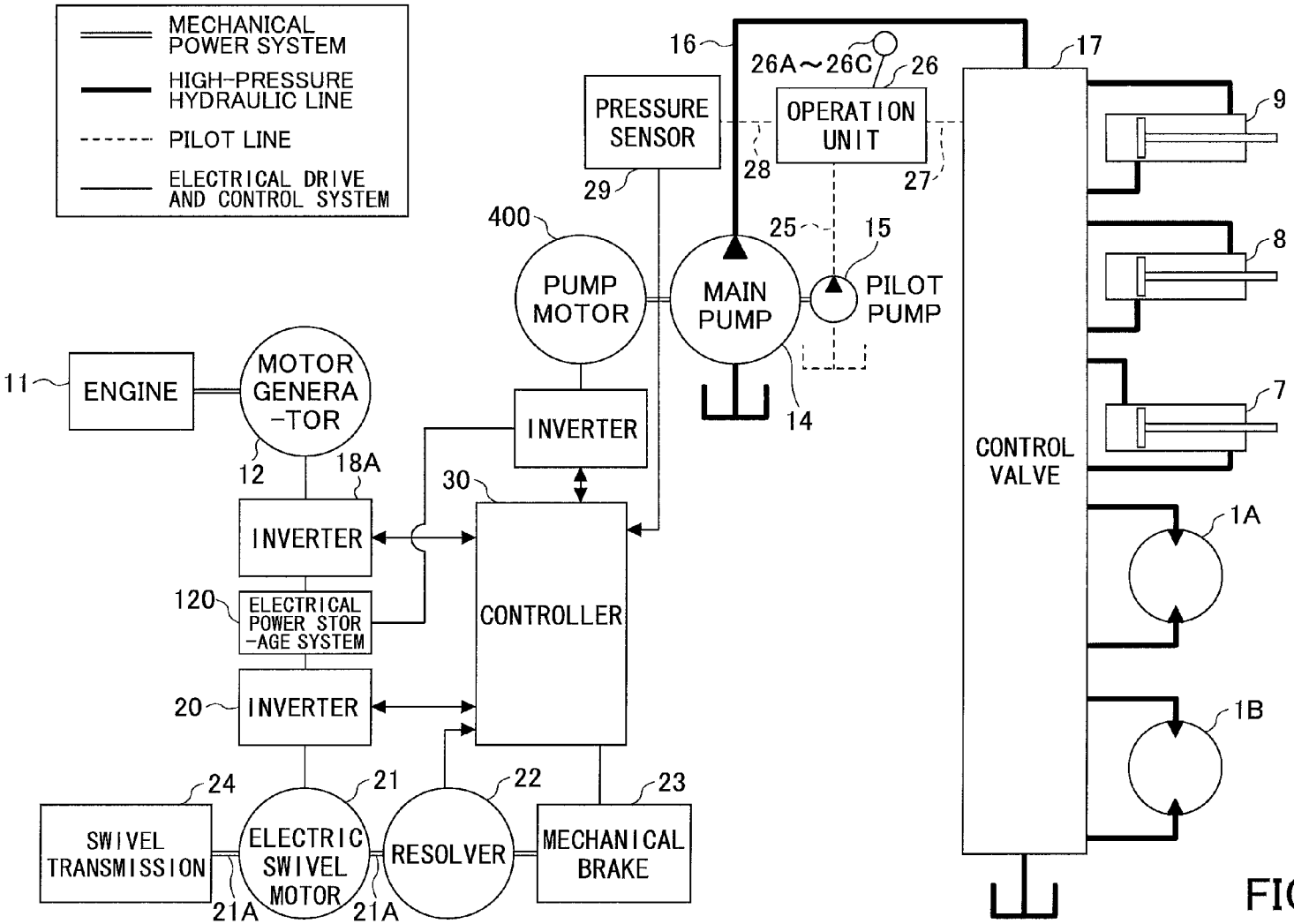
FIG. 19 is a block chart illustrating a structure of a drive system of a hybrid shovel of a series type.

In the above embodiment, a so-called parallel-type hybrid shovel, in which the engine 11 and the motor generator 12 are connected to the main pump 14 being the hydraulic pump to thereby drive the main pump 14, is applied to the present invention. However, the embodiment is applicable also to a so-called series-type hybrid shovel, in which the motor generator 12 is driven by the engine 11, electric power generated by the motor generator 12 is accumulated in the electric power storage system 120, and a pump motor 400 is driven by only the stored electric power to drive the main pump 14, as illustrated in FIG. 19. In this case, the motor generator 12 has a function of performing as a generator of performing only a generation operation by being driven by the engine 11.

Figure 20:
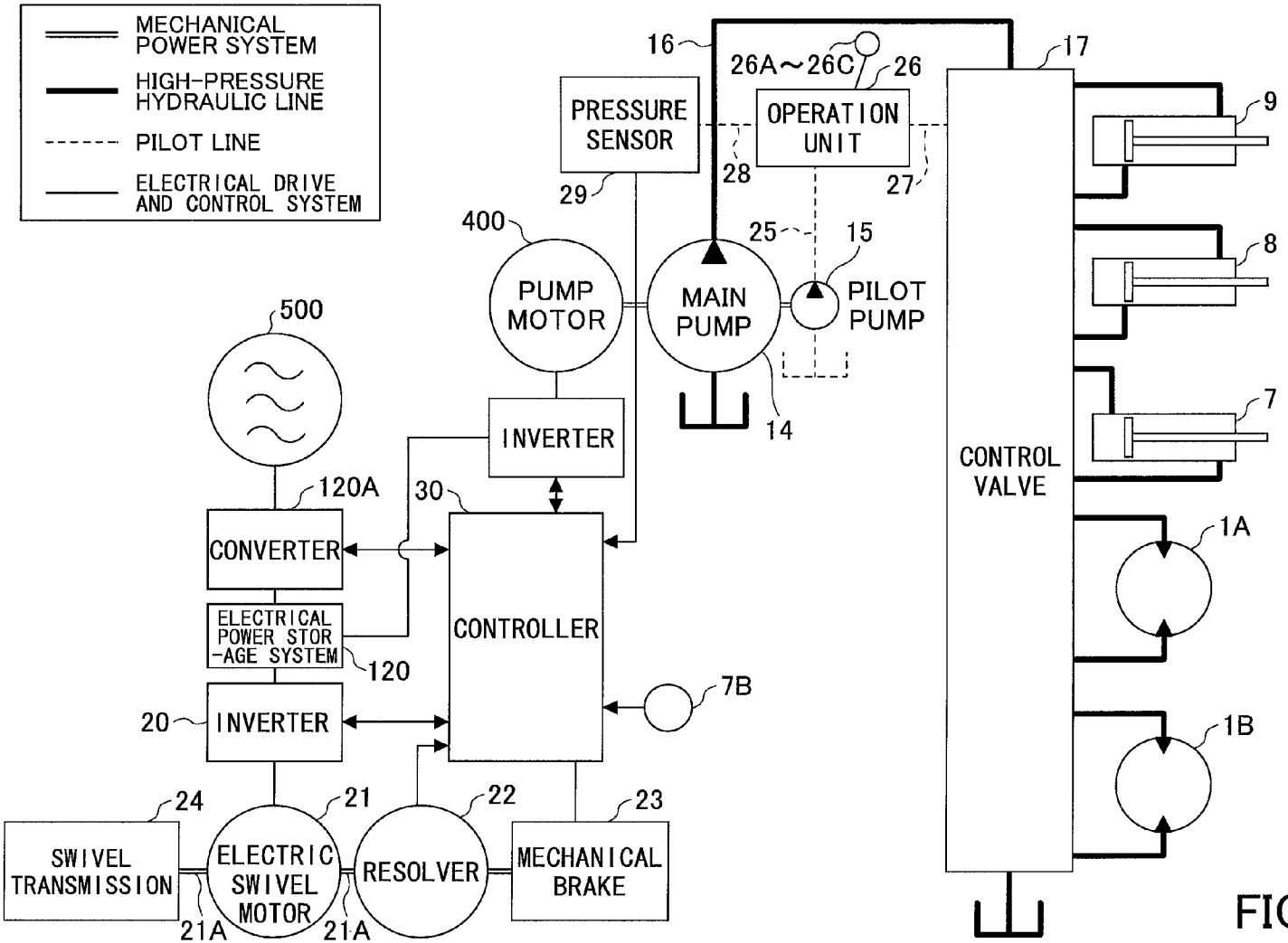
FIG. 20 is a block chart illustrating structure of a drive system of an electric shovel.

Further, the present invention is not limited to the hybrid shovel and is applicable to an electric shovel as illustrated in FIG. 20. The electric shovel illustrated in FIG. 10 is not provided with the engine 11 and the main pump 14 is driven by only the pump motor 400. The electric power used by the pump motor is supplied by only electric power generated by the electrical power storage system 120. An external power source 500 is connectable to the electrical power storage system 120 through the converter 120A. The electric power is supplied from the power source 500 to the electrical power storage system 120 to charge an electrical power storage device. The electrical power is supplied from the electrical power storage device to the pump motor 400.

The present invention is not limited to the above embodiments where the above shovel specifically disclosed, as an example. Various modified examples and altered examples are to be provided without departing from the scope of the present invention.

EXPLANATION OF REFERENCE SYMBOLS

1: lower-part travel body;
1A, 1B: hydraulic motor;
2: swivel mechanism;
3: upper-part swivel body;
4: boom;
5: arm;
6: bucket;
7: boom cylinder;
7B: boom angle sensor;
8: arm cylinder;
8A: arm angle sensor;
9: bucket cylinder;
10: cabin;
11: engine;
12: motor generator;
13: transmission;
14: main pump;
15: pilot pump;
16: high-pressure hydraulic line;
17: control valve;
18, 20: inverter;
19: capacitor;
21: electric swivel motor;
22: resolver;
23: mechanical brake;
24: swivel transmission;
25: pilot line;
26: operation unit;
26A, 26B: lever;
26C: pedal;
27: hydraulic line;
28: hydraulic line;
29: pressure sensor;
30: controller;
40: swivel control part;
42: acceleration and deceleration determining part;
42*a*: acceleration map;
42*b*: deceleration map;
43: torque determining part;
43*a*: acceleration torque map;
43*b*: deceleration torque map;
44: smoothing part;
45: posture determining part;
46: speed command calculating part;
48: switch part;
50: speed command calculating part;
51: torque command generating part;
52: torque command generating part;

60: speed command generating part;
62: speed command correcting part;
64: swivel radius calculating part;
100: buck-boost converter;
110: DC bus;
111: DC bus voltage detecting unit;
112: capacitor voltage detecting unit;
113: capacitor current detecting unit;
120: electrical power storage system;
400: pump motor; and
500: outer power source.

It should be understood that the invention is not limited to the above-described embodiment, but may be modified into various forms on the basis of the spirit of the invention. Additionally, the modifications are included in the scope of the invention.

What is claimed is:

1. A swivel control apparatus for swiveling a swivel body that supports an attachment including a boom, an arm, and an end attachment by a motor, wherein a swivel drive command to the motor is changed in response to a change of a posture of the attachment including a swivel radius of the attachment, wherein as the swivel radius of the attachment becomes greater so that a swivel radius of the end attachment becomes greater, the swivel drive command to the motor is changed to be smaller, wherein the swivel drive command to the motor is changed to be smaller at least at positions of the end attachment of a leading end operation range, an upper part operation range, and a lower part operation range.

2. The swivel control apparatus according to claim 1, wherein the swivel drive command relates to an acceleration or a deceleration of the motor, wherein as the swivel radius of the attachment becomes greater, the swivel drive command is changed to be smaller.

3. The swivel control apparatus according to claim 2, the swivel control apparatus further comprising:

a drive command determining part for determining the acceleration or the deceleration of a swivel motion of the swivel body in response to the posture of the attachment; and a speed command generating part that generates a swivel speed command by integrating the acceleration or the deceleration output by the drive command determining part.

4. The swivel control apparatus according to claim 3, the swivel control apparatus further comprising:

an interpolation operating part that interpolates the acceleration or the deceleration output by the drive command determining part to smooth the acceleration or the deceleration output by the drive command determining part so that the acceleration or the deceleration output by the drive command determining part smoothly change.

5. The swivel control apparatus according to claim 3, the swivel control apparatus further comprising:

an interpolation operating part that interpolates an acceleration torque or an deceleration torque so that a torque output by the drive command determining part smoothly changes.

6. The swivel control apparatus according to claim 3, wherein the drive command determining part determines a drive command at a time of accelerating or decelerating the swivel motion by referring to a prepared acceleration drive command map for the acceleration of the swivel motion or a prepared deceleration drive command map for the deceleration of the swivel motion, and outputs the determined drive command.

7. The swivel control apparatus according to claim 6, wherein the drive command determining part separately includes both of the acceleration drive command map for the acceleration of the swivel motion or a prepared deceleration drive command map for the deceleration of the swivel motion, and outputs the determined drive command.

8. The swivel control apparatus according to claim 3, wherein the motor is controlled based on the torque command output by the drive command determining part.

9. The swivel control apparatus according to claim 1, the swivel control apparatus further comprising:

a first swivel drive command generating portion that generates a first swivel drive command to be sent to the motor based on a lever operation amount;

a second swivel drive command generating portion that generates the drive command to be sent to the motor as a second swivel drive command; and a switch part that switches between the first swivel drive command and the second swivel drive command based on a result of comparing the first swivel drive command with the second swivel drive command.

10. The swivel control apparatus according to claim 9, wherein the second swivel drive command is output when the second swivel drive command is smaller than the first swivel drive command.

11. The swivel control apparatus according to claim 1, further comprising:

a swivel operation lever which operates the swivel body, wherein the swivel drive command is a speed command of the motor generated based on a lever operation amount of the swivel operation lever, wherein as the swivel radius of the attachment becomes greater, the swivel drive command is changed to be smaller.

12. The swivel control apparatus according to claim 11, the swivel control apparatus further comprising:

a speed command correcting part that corrects the speed command in response to the posture of the attachment, wherein the speed command correcting part corrects the speed command by multiplying the speed command by a correction value.

13. The swivel control apparatus according to claim 12, wherein as a swivel radius of the attachment becomes greater, the correction value becomes smaller.

14. A swivel control apparatus for swiveling a swivel body that supports an attachment including a boom, an arm, and an end attachment by a motor, wherein a swivel drive command to the motor is changed in response to a change of a posture of the attachment, wherein the boom is supported by the swivel body, the arm is supported by the boom, and the end attachment is supported by the arm, wherein a position of the end attachment is used as the posture of the attachment, wherein in a case where the position of the end attachment is in any one of a leading end operation range, an upper part operation range, and a lower part operation range, the swivel drive command is changed to be smaller in comparison with a case where the position of the end attachment is not in the leading end operation range, the upper part operation range, or the lower part operation range.

15. The swivel control apparatus according to claim 14, further comprising:

a boom angle sensor; and an arm angle sensor, wherein the position of the end attachment is calculated based on information obtained by the boom angle sensor and the arm angle sensor.

16. A swivel control apparatus for swiveling a swivel body that supports an attachment including a boom, an arm, and an end attachment by a motor, wherein a swivel drive command to the motor is changed in response to a change of a posture of the attachment, wherein the boom is supported by the swivel body, the arm is supported by the boom, and the end attachment is supported by the arm, wherein a position of the end attachment is used as the posture of the attachment, wherein in a case where the position of the end attachment is in a proximity operation range, the swivel drive command is changed to be greater in comparison with a case where the position of the end attachment is not in the proximity operation range.

17. The swivel control apparatus according to claim 16, further comprising:

a boom angle sensor; and an arm angle sensor, wherein the position of the end attachment is calculated based on information obtained by the boom angle sensor and the arm angle sensor.

* * * * *